US006210025B1

(12) United States Patent
Schmidt et al.

(10) Patent No.: US 6,210,025 B1
(45) Date of Patent: Apr. 3, 2001

(54) LENSED TROFFER LIGHTING FIXTURE

(75) Inventors: Peter Michael Schmidt, Conyers; Roger Erle Norris, Covington; Jeffrey Wayne Kaiser, Snellville, all of GA (US)

(73) Assignee: NSI Enterprises, Inc., Atlanta, GA (US)

( * ) Notice: Subject to any disclaimer, the term of this patent is extended or adjusted under 35 U.S.C. 154(b) by 0 days.

(21) Appl. No.: 09/358,376

(22) Filed: Jul. 21, 1999

(51) Int. Cl.[7] ..... F21V 15/00
(52) U.S. Cl. ..... 362/362; 362/217
(58) Field of Search ..... 362/270, 217, 362/223, 260, 362

(56) References Cited

U.S. PATENT DOCUMENTS 5,806,972 * 9/1998 Kaiser et al. ..... 362/290
5,823,663 * 10/1998 Bell et al. ..... 362/362
6,102,550 * 8/2000 Edwards, Jr. ..... 362/221

* cited by examiner

*Primary Examiner*—Alan Cariaso
*Assistant Examiner*—Ronald E. DelGizzi
(74) *Attorney, Agent, or Firm*—Kenneth E. Darnell

(57) ABSTRACT

An improved lensed fluorescent troffer lighting fixture intended for ceiling mounting and particularly for recessed mounting to a suspended ceiling grid within a shallow plenum, the embodiments of the fixture having dimensions, particularly depth-wise dimensions, which allow installation within the confines of reduced plenums while maintaining fixture quality and retaining desirable characteristics such as minimal lamp image. The present lensed troffers can be manufactured at a high assembly rate due to the ability to snap together on an assembly line the various components of the fixture without the use of separate fasteners. The lensed troffers of the invention are particularly configured for use with T8 fluorescent lamping and low profile electronic ballast. The configurations of the several embodiments of the present lensed troffer are chosen to fit within a shipping box shaped in a manner to allow maximum stacking efficiency and to maximize the number of fixtures which can be shipped within conventional volumes encountered in available transport vehicles.

25 Claims, 23 Drawing Sheets

LENSED TROFFER LIGHTING FIXTURE

BACKGROUND OF THE INVENTION

1. Field of the Invention

The invention relates generally to lensed fluorescent troffer lighting fixtures and particularly to a fixture housing having a reduced profile to allow installation within the reduced volume of shallow plenums commonly encountered in ceiling structures, the housing further being capable of rapid manufacture due to the secure fitting together of components of the housing without the need for separate fasteners.

2. Description of the Prior Art

Lensed fluorescent lighting fixtures are commonly employed in commercial, institutional and industrial applications due primarily to the energy efficiency of fluorescent fixtures generally coupled with relatively low fixture cost even in specification premium installations. Fluorescent lighting in the form of lensed fluorescent troffer lighting fixtures provides acceptable lighting solutions in office environments as well as in other task lighting applications. In such applications as in a commercial office building, literally thousands of fluorescent troffer lighting fixtures are mounted by suspended ceiling grid arrangements and provide desirable lighting performance and pleasing appearance. Lensed fluorescent troffer lighting fixtures can also be surface mounted while providing similar performance. In recessed applications, however, the space within which lighting fixtures are to be mounted has become increasingly smaller, these applications typically being referred to as reduced plenum installations, it being necessary to provide a fluorescent troffer lighting fixture of reduced volume and particularly of reduced depth to allow ready mounting within reduced plenums and yet retain desirable performance characteristics such as minimal lamp image with desirable light outputs. Within this context, the need has further increased in the industry to provide fixtures which can be manufactured at minimum cost yet exhibit exceptionally high performance. Such fixtures must be capable of manufacture with low material cost, low labor cost and must be shipped to a job site with maximum volumetric shipping efficiency. Once at a job site, such low-cost, high performance fixtures must be capable of rapid installation and also provide ever-increasing energy efficiencies while producing desired illumination levels. Lensed fluorescent troffer lighting fixtures must therefore provide a marriage of aesthetic and performance considerations at minimum manufacturing and shipping costs. Grid-type lensed fluorescent troffer lighting fixtures in the present marketplace must be as shallow as possible while still enabling lamping of the fixture while using a minimum of material and retaining the capability of being mounted within conventional grid arrangements including plenums of reduced volume and height. Specification premium lensed fluorescent troffer lighting fixtures such as are produced according to the present invention typically have a greater depth in order to retain desirable lamp image characteristics and are further provided with reflective internal structure capable of preventing light from being trapped behind lamping, thereby to provide maximum illumination efficiencies. In the several embodiments of the invention, deficiencies of the prior art are eliminated in part by use of fluorescent lamping having smaller diameter tubular elements, such as T8 lamping, and relatively low profile electronic ballasts rather than more bulky conventional magnetic ballasts. Economies in manufacture occur according to the present invention through the use of smaller components to form smaller lighting fixtures which retain dimensions necessary for mounting to conventional suspended ceiling grid arrangements, etc. Still further, the structure of those components forming fixture body assemblies as an example is configured to avoid the use of separate fastening elements in the manufacture of such assemblies. Structural portions of present fixture body assemblies are provided with integral fastening elements which allow snap-fit assembly without the need for screws or the like which must be procured separately and separately brought to the assembly location. Fasteners such as screws and the like are also difficult to work with in assembly situations due to small size and the usual necessity for manual placement and manipulation of the fastener. In such situations, a tool is ordinarily required to secure the fastener to the structural elements of the fixture which must be joined together quickly and with precision.

An example of a lensed fluorescent troffer lighting fixture is seen in U.S. Pat. No. 3,045,577 to Lazerson. The Lazerson structure requires use of separate fasteners which limit production in an assembly line environment. The Lazerson structure is also not shaped to allow rapid and efficient mounting in reduced plenum environments and for maximization of fixture stacking once packaged which leads to maximizing of the number of fixtures which can be shipped in conventional transport vehicles. Lewin, in U.S. Pat. No. 3,988,609, describes a lensed troffer lighting fixture intended to be improved by greater efficiencies in a lighting panel or prismatic lens cover provided for the fixture, the fixture itself not being improved relative to the prior art.

Bell et al, in U.S. Pat. No. 5,823,663, describe a fluorescent troffer lighting fixture and particularly a parabolic troffer formed of a housing assembly capable of snap-fit assembly. Kaiser et al, in U.S. Pat. No. 5,806,972, describe a light trap and louver mounting arrangement useful with the housing assembly disclosed in the Bell et al patent. The parabolic troffers disclosed by Bell et al and Kaiser et al relate to the present lensed fluorescent troffers only in the similar concept of providing structure capable of snap-fit assembly without the need for separate fasteners, the particular structures of the present lensed troffers differing from corresponding structures as disclosed in the Kaiser et al and Bell et al patents.

The invention thus provides a lensed fluorescent troffer lighting fixture and particularly a lighting fixture housing assembly wherein the housing assembly is capable of snap-fit assembly of structural body elements without the need for separate fasteners. The structural body elements of the invention which form the housing assembly are provided with fastening elements which are integral with the body elements, thereby yielding savings in material costs as well as in assembly costs while providing a fixture housing assembly having excellent mechanical performance and which contributes to overall fixture lighting performance. The housing assembly of the present lensed troffer lighting fixture further enables production of a fixture having minimum depth to allow installation in reduced plenum environments while retaining desirable performance characteristics including reduction of lamp image and production of desired illumination levels. These performance characteristics are obtained even though preferred lamping for the present fixtures comprises T8 fluorescent lamps which have smaller diameters than commonly employed T12 lamping. The advantages of the invention occur with the retention of traditional and necessary functions such as efficient mounting of a door frame carrying a prismatic lens cover and the like.

SUMMARY OF THE INVENTION

The present invention provides a lensed fluorescent troffer lighting fixture and particularly a fixture housing assembly capable of assembly from a minimum of component parts, assembly being particularly suited according to the structure of the component parts to automated fabrication. The housing assembly of the invention is not only structurally simple and readily fabricated on a conventional assembly line, the housing assembly is economical in use of materials and in the labor required for manufacture while being sized to efficiently fit within reduced plenums available in common ceiling structures. While sized to fit in conventional suspended ceiling grid arrangements and the like, the present fixture housing assembly has a substantially reduced depth-wise dimension which retains desirable characteristics such as minimum lamp image and efficient light output. The rugged construction of the present fixture housing assembly permits maintenance of desired body contours during handling and use after assembly, the ability of the housing assembly to assume and retain body contours including internal parabolic contours causing the lensed troffer fixture itself to exhibit excellent lighting performance. The strength of the housing assembly is occasioned by a rugged yet precise configuration of structural components which integrally carry fastening structure enabling the snap-fitting together of the structural components substantially without the use of separate fasteners. The fitting together of the structural components forming the present lensed troffer lighting fixture eliminates light leaks while minimizing shadows and bright spots.

The integral fastening elements provided according to the invention on the several structural components of the fixture housing assembly include cooperating fastening elements which permit inordinately rapid and ready assembly of the structural components to form the present housing assembly. The integral fastening elements of the present structural components are configured to allow snap-fastening of the structural components together in a manner which assures a locking together of said components which is reliable and precise, the operations involved in assembly of the fixture being amenable to automated fabrication. The very substantial structural integrity of the present housing assembly virtually eliminates accidental or inadvertent loss of structural integrity in an installation. The rugged structural integrity of the present housing assembly not only provides for safety in use of the lighting fixture but also provides economies of fabrication and assembly without sacrifice of fixture performance.

The housing assembly of the invention is configured to maximize the number of fixtures which can be stacked in shaped boxes, the dimensions thereof being chosen for facilitating shipping of a maximum number of fixtures within a given volume present in a transport vehicle.

Lighting performance, particularly for specification premium lensed fluorescent troffer fixtures according to the invention, is improved by use of high performance, diffusive paints coated onto reflective surfaces of the housing assembly. Further, rib-like elements can be provided between lamping and the paint-coated reflective surfaces to prevent light from being trapped behind lamping, various configurations being employed depending upon whether a given lighting fixture utilizes two, three or four lamps.

Lamping preferably used according to the invention takes the form of elongated fluorescent bulbs having a diameter of approximately one inch, such bulbs being generally referred to as T8 fluorescent lamps. Such T8 lamps are preferably used with electronic ballasts and particularly low profile electronic ballasts in order to facilitate reduction of fixture depth. In specification premium embodiments of the invention, the distance of lowermost portions of the lamping to upper surfaces of a prismatic cover using T8 lamping as preferred according to the invention is the same distance as in prior art fixtures utilizing T12 lamping. Fixtures so configured according to the invention retain desired perceptions of product quality while exhibiting necessary reductions of lamp image and producing desirable illumination levels.

Accordingly, it is an object of the invention to provide a lensed fluorescent troffer lighting fixture which is capable of high levels of lighting efficiency and which is characterized by superior mechanical construction even though the fixture is simply and ruggedly constructed using standard automated fabrication techniques.

It is another object of the invention to provide a lensed fluorescent troffer lighting fixture which can be assembled through the expedient of fastening elements formed integrally with structural components of a fixture housing assembly, the housing assembly thus being capable of rapid and economical assembly from structural components, the present fixture being capable of fabrication using standard automated fabrication techniques.

It is yet another object of the invention to provide a lensed fluorescent troffer lighting fixture sized to be mounted by suspended ceiling grid arrangements of conventional design and which have depth-wise dimensions which allow installation in reduced plenums.

Further objects and advantages of the invention will become more readily apparent in light of the following detailed description of the preferred embodiments.

DESCRIPTION OF THE PREFERRED EMBODIMENTS

Figure 1A:
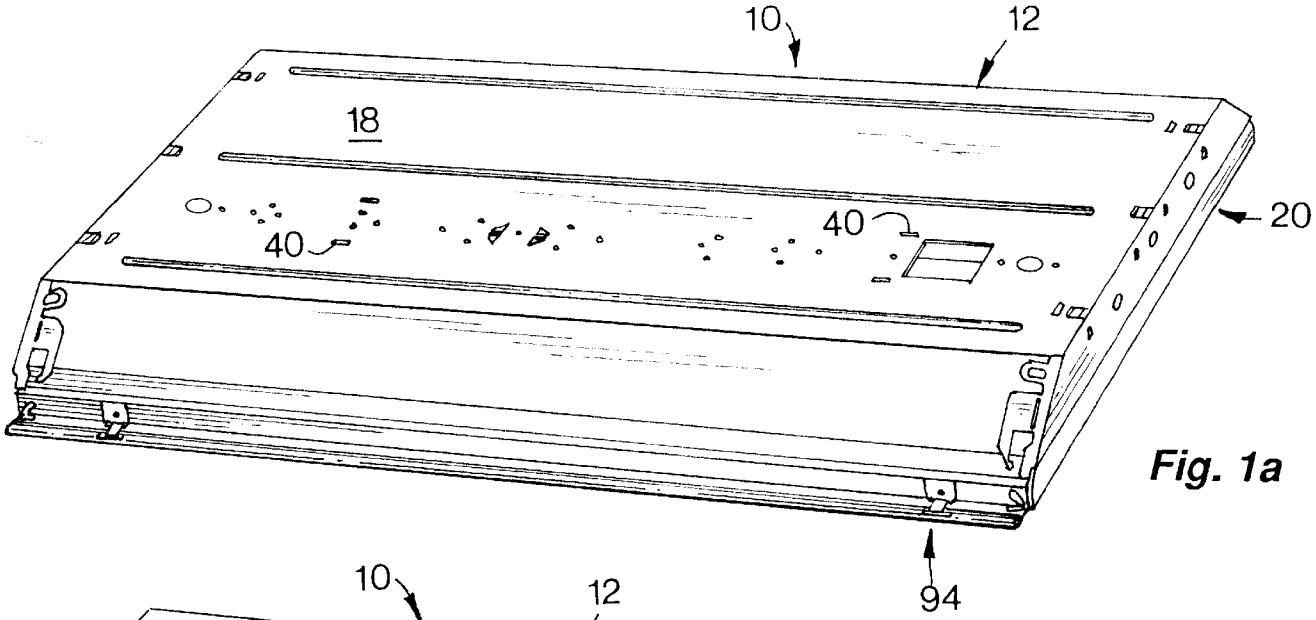
FIGS. 1A and B are perspective views of the lighting fixture of the invention taken from a location above and toward ends thereof.

Copending U.S. patent application Ser. No., 09/358,378, for "Door Frame for Lensed Troffer", filed of even date and assigned to the present assignee, and copending U.S. patent application Ser. No. 09/298,298, entitled "Inverted Apex Prismatic Lens", filed Apr. 23, 1999 and assigned to the present assignee, contain disclosures which are incorporated hereinto by reference.

Referring now to the drawings and particularly to FIGS. 1 through 4, a lensed fluorescent troffer lighting fixture is seen at 10 to be comprised of a housing assembly 12 and a door frame 14 which carries a prismatic lens cover 16. The door frame 14 is hinged to the housing assembly 12 in a manner referred to hereinafter and described in detail in copending U.S. patent application Ser. No. 09/358,378, entitled "Door Frame for Lensed Troffer", filed of even date and assigned to the present assignee, the disclosure of which is incorporated hereinto by reference as aforesaid. Further, the door frame 14 is latched to the housing assembly 12 in a manner referred to hereinafter and described in detail in said copending patent application. The lens cover 16 can take a variety of forms including conventional A-12 and A-19 patterns as well as the particular lens structures disclosed and claimed in copending U.S. patent application Ser. No. 09/298,298, entitled "Inverted Apex Prismatic Lens", filed Apr. 23, 1999 and assigned to the present assignee, the disclosure of this patent application being incorporated hereinto by reference.

Figure 1B:
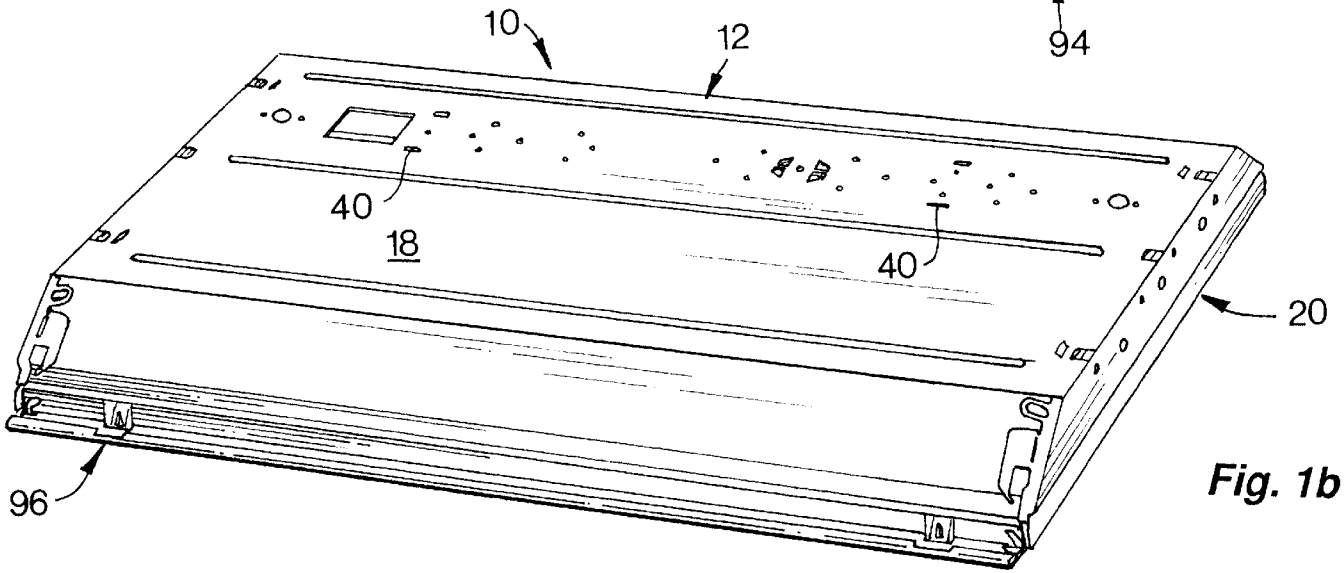
Figure 2:
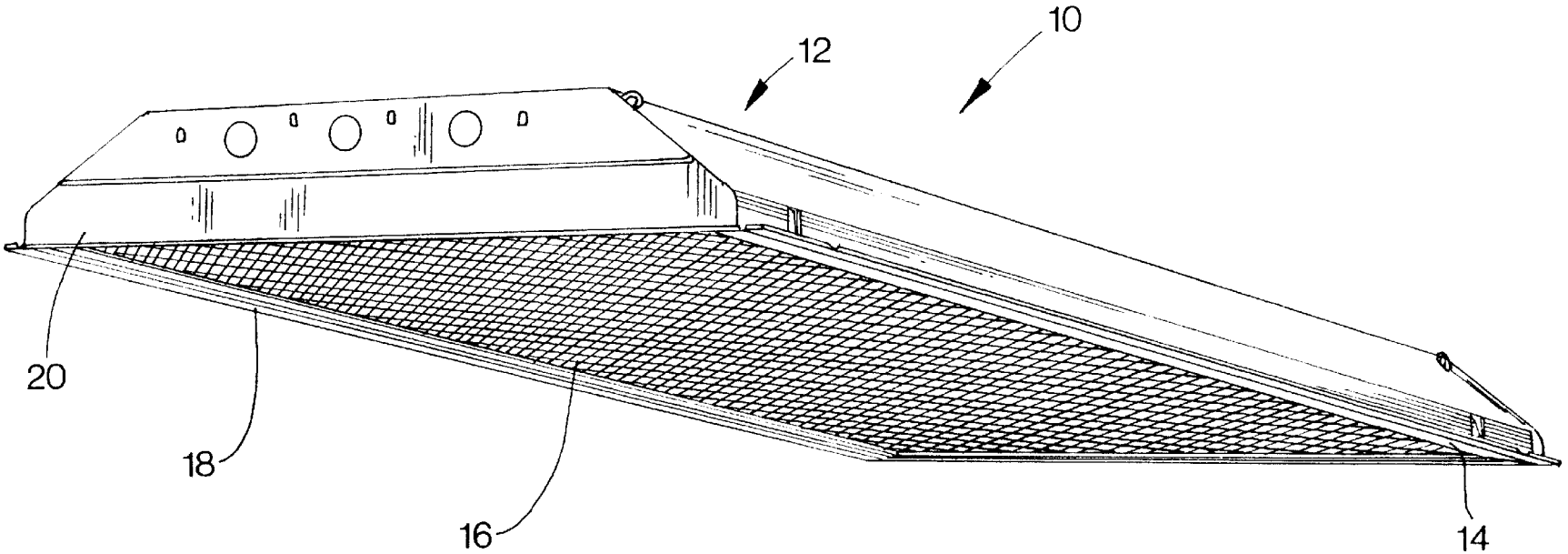
FIG. 2 is a perspective view of the lighting fixture of the invention taken from below and toward one end of the lighting fixture.
Figure 3:
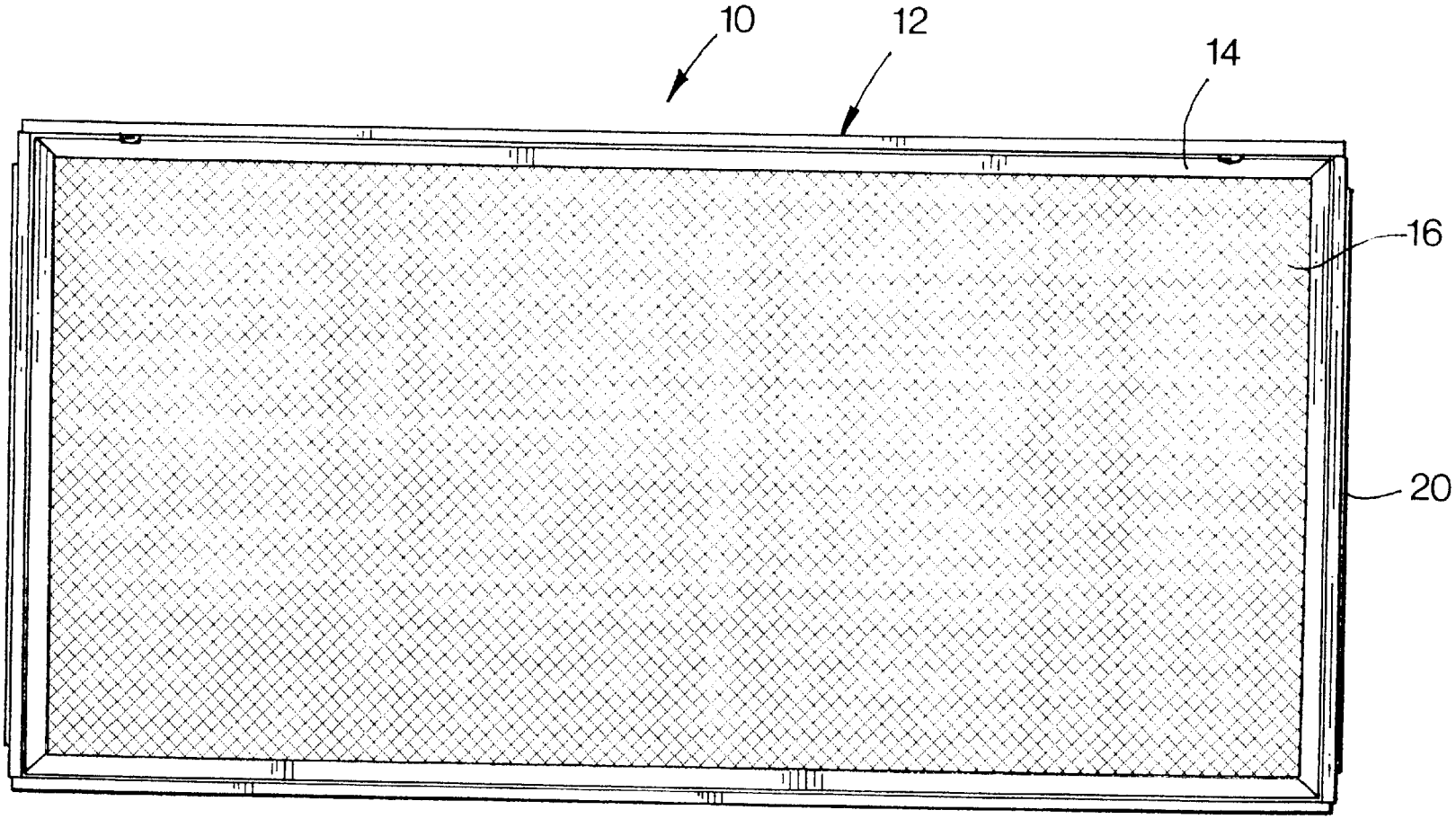
FIG. 3 is an elevational view taken from below the lighting fixture.
Figure 4:
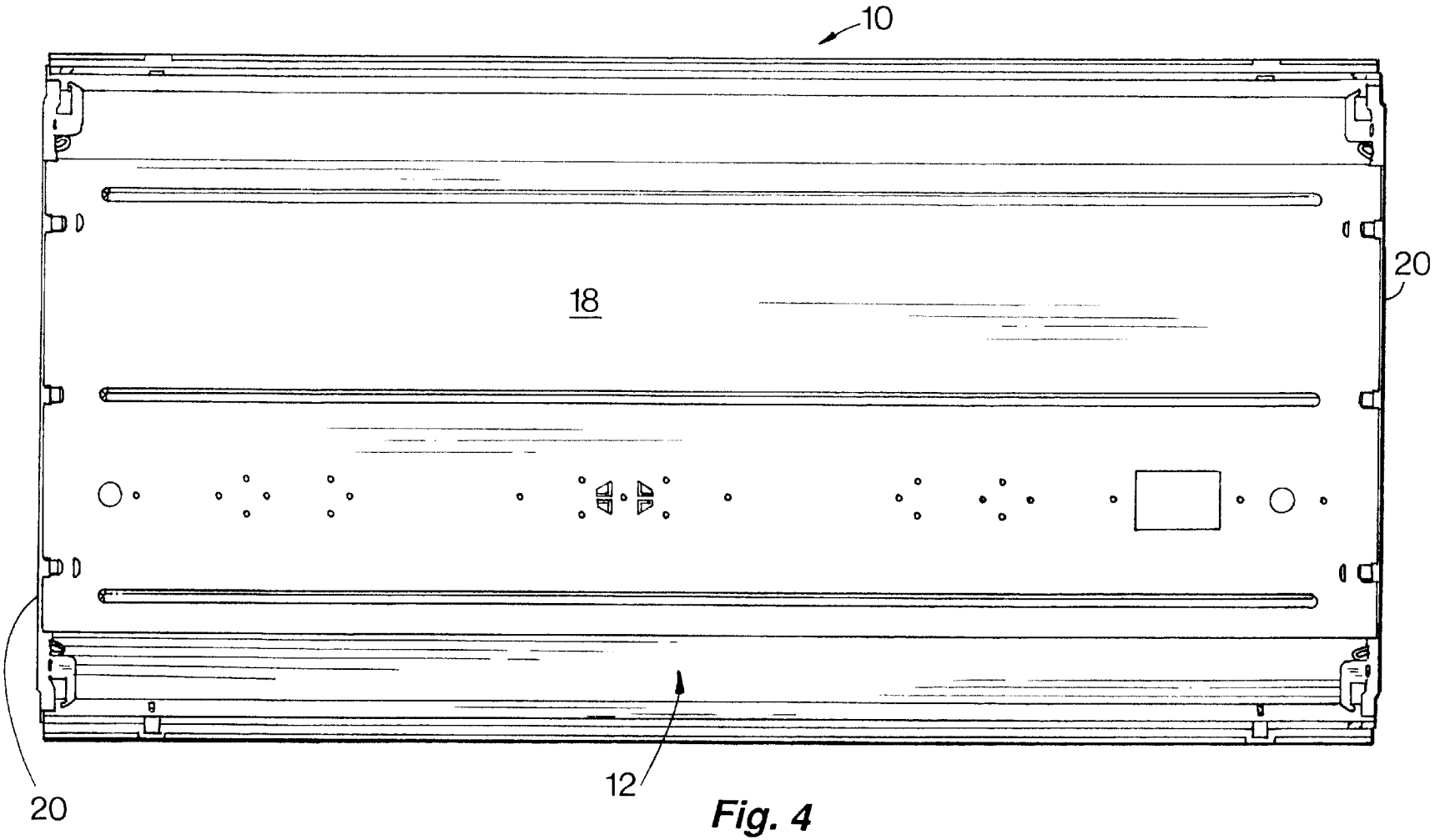
FIG. 4 is a plan view of the lighting fixture.
Figure 5:
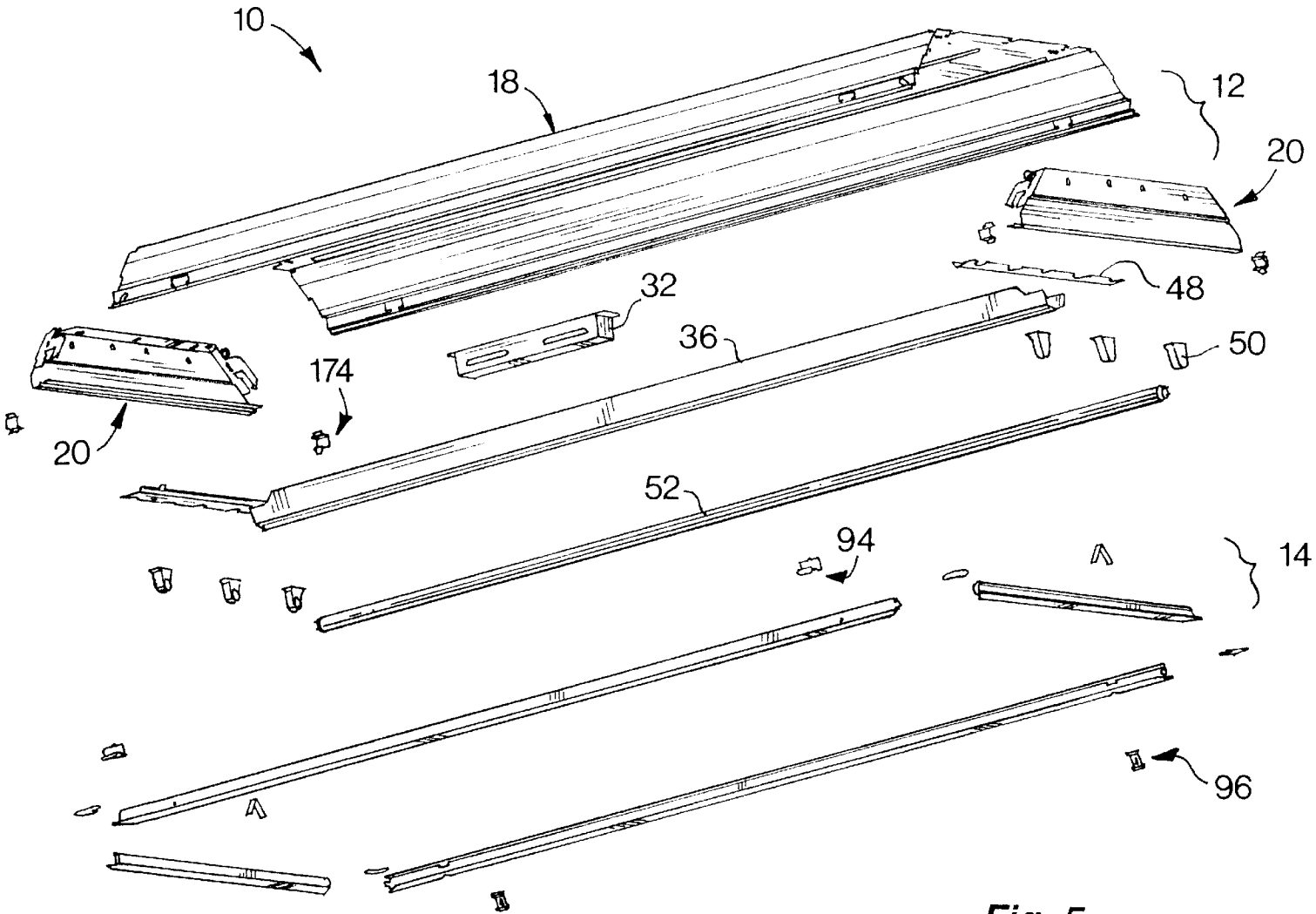
FIG. 5 is an exploded assembly view of the lighting fixture of FIGS. 1 through 4 with a prismatic lens cover removed in order to show the primary structural components of the fixture in a scale which is as large as possible.
Figure 6:
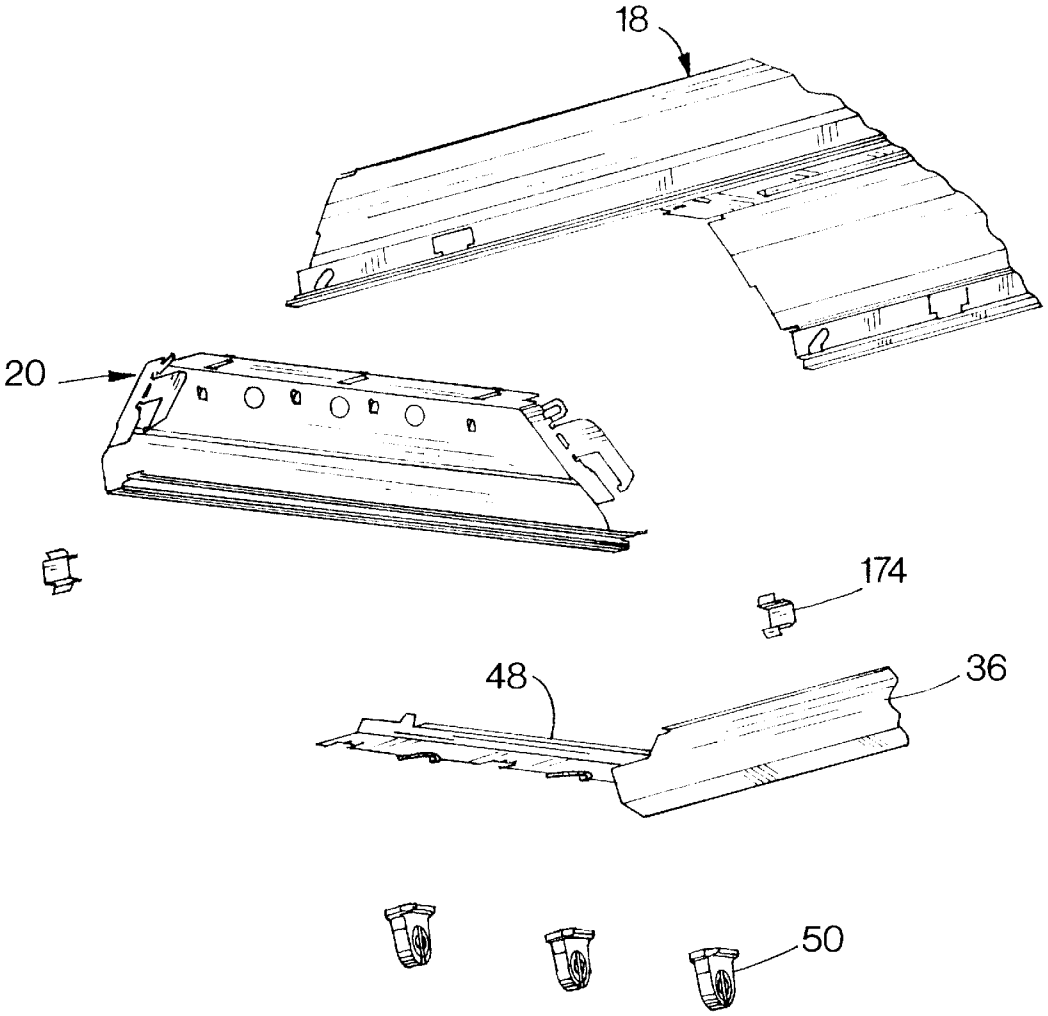
FIG. 6 is an exploded assembly view of one end of the lighting fixture of the invention.

As can be seen in FIGS. 1 and 2 as well as FIGS. 5 and 6 inter alia, the housing assembly 12 is primarily formed of a housing channel 18 which is shown in detail in FIGS. 8A through 8D and two end plates 20, one of which is shown in detail in FIGS. 9A through 9E. The housing channel 18 and the end plates 20 are also shown in FIGS. 5 and 6 inter alia. The manner in which the end plates 20 are connected to each end of the housing channel 18 will be described in detail hereinafter.

Figure 8D:
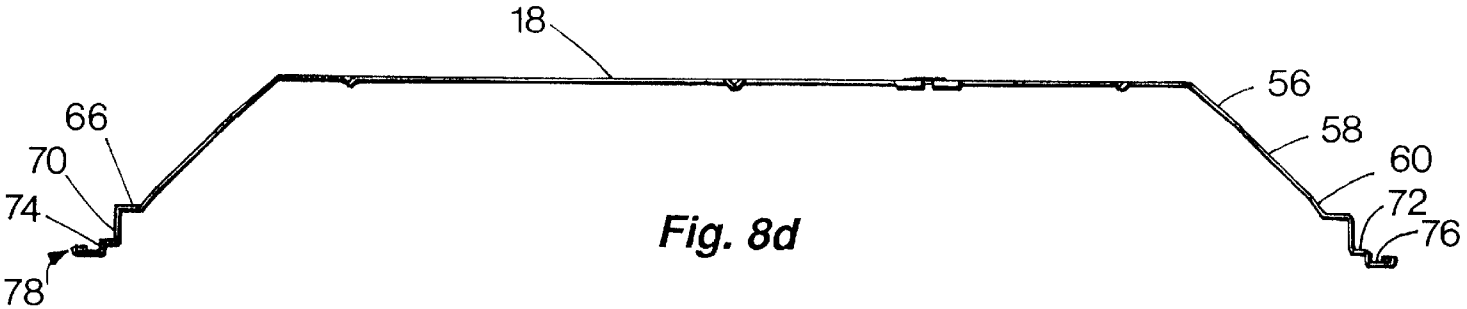
FIGS. 8A through 8F are perspective, plan, side elevational, end elevational and detail views of a housing channel forming a portion of a housing assembly of the invention.
Figure 8F:
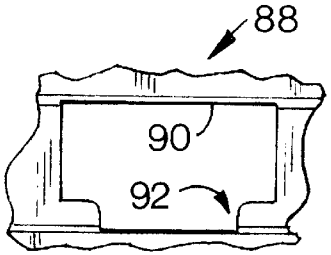
Figure 16:
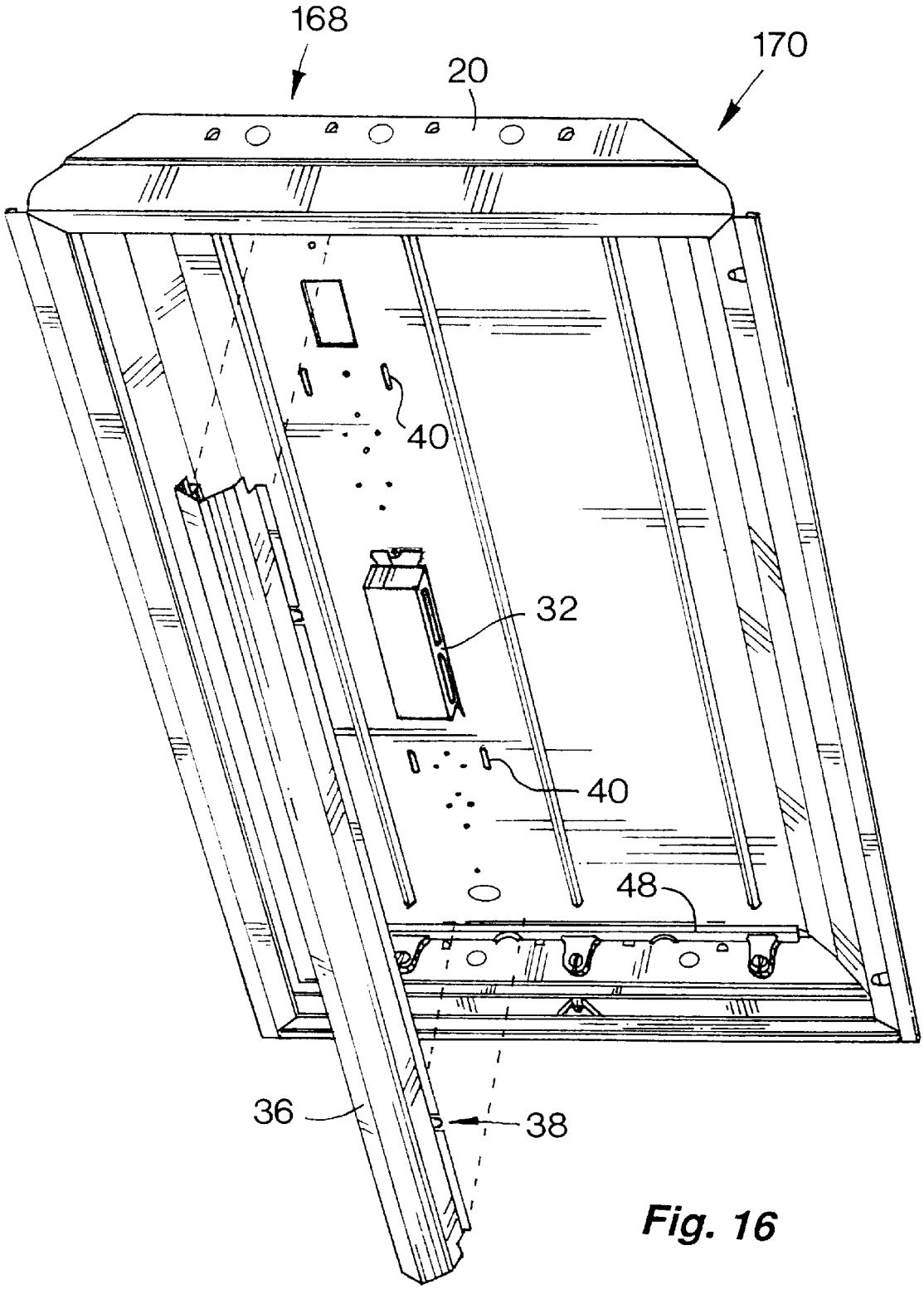
FIG. 16 is a perspective view of a housing assembly forming a part of the lighting fixture of FIG. 13 illustrating a cover channel in exploded relation to remaining portions of a housing assembly configured according to the invention.

Referring first to FIGS. 8A through 8D, the housing channel 18 is seen to be preferably formed of a unitary piece of material, typically 22 gauge steel which is shaped and provided with cutouts to yield the housing channel 18. The respective ends of the housing channel 18 are essentially identical to each other as are the respective sides and side edges of said housing channel 18. The profile in section of the housing channel 18 is essentially identical throughout most of its length as is seen in FIG. 8D. Various projections, cutouts and indentations inter alia alter the profile or cross-section of the channel 18 slightly from one end to the other. The housing channel 18 comprises a substantially planar upper body portion 22 which essentially forms the "top" of the lighting fixture 10. Indentations 24 are formed at three spaced locations of the body portion 22 and extend along the length of the channel 18 to provide a strengthening effect as well as to function as reflectors to prevent light from being trapped above the lamp 52 as best illustrated in FIG. 18. Depending on lamping, more or fewer of the indentations can be used. An access opening 26 is formed in the body portion 22 near one end of the channel 18, this opening 26 allowing access into the interior of the lighting fixture 10 once installed. The opening 26 can be covered with a cover plate (not shown) as desired. Knockouts 28 are provided in the event that a wiring access or the like is necessary. Crimps 30 punched from the body portion 22 mount a ballast 32 in a conventional manner as can best be seen in FIG. 16. The ballast 32 is conventionally mounted through the use of two of the crimps 30 and by the use of a single screw (not shown) received into one of the holes 34 formed in the body portion 22 and in alignment with the opening 26, the knockouts 28 and the crimps 30, these elements formed in the body portion 22 being covered by means of a generally U-shaped channel cover 36 as also seen in FIG. 16 and as seen in the fully covering position in FIG. 17. The channel cover 36 is provided with tabs 38 which fit into spaced apart slots or hooded bosses 40 formed in the body portion 22.

Figure 10A:
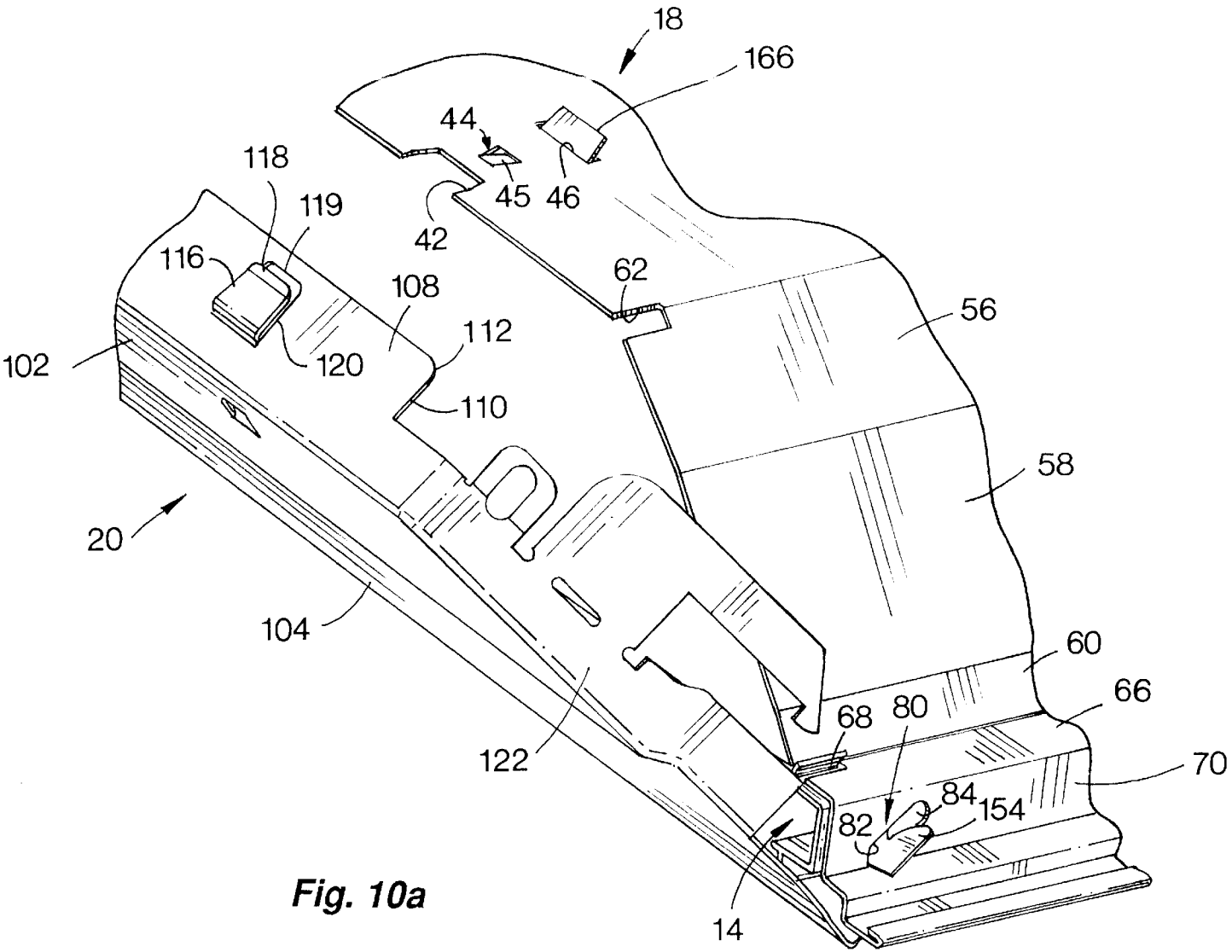
FIGS. 10A, B and C are detail perspective views illustrating the assembly of an end plate to a channel to form a housing assembly according to the invention.

The upper body portion 22 of the housing channel 18 is further provided at each end with three shaped cutouts 42 spaced apart along each end of the channel 18. The cutouts 42 have trapezoidally shaped inner portions which act as lead-ins for structure mating therewith and formed on the end plates 20. Immediately inwardly of each of the cutouts 42 as seen in FIGS. 8 and 10 is formed a trapezoidally shaped indentation 44 each having a plate 45 formed therewith. The indentations 44 are stamped into the material forming the upper body portion 22. Immediately inwardly of the outermost pair of the indentations 44 at each end of the channel 18 are formed slots 46 disposed transversely of the channel 18, the cutouts 42, the indentations 44 and the plates 45 facilitating mounting of one of the end plates 20 to each end of the channel 18 as will be described hereinafter relative to FIG. 10A.

Figure 8E:
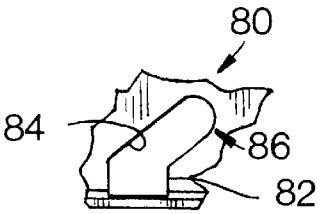
Figure 8A:
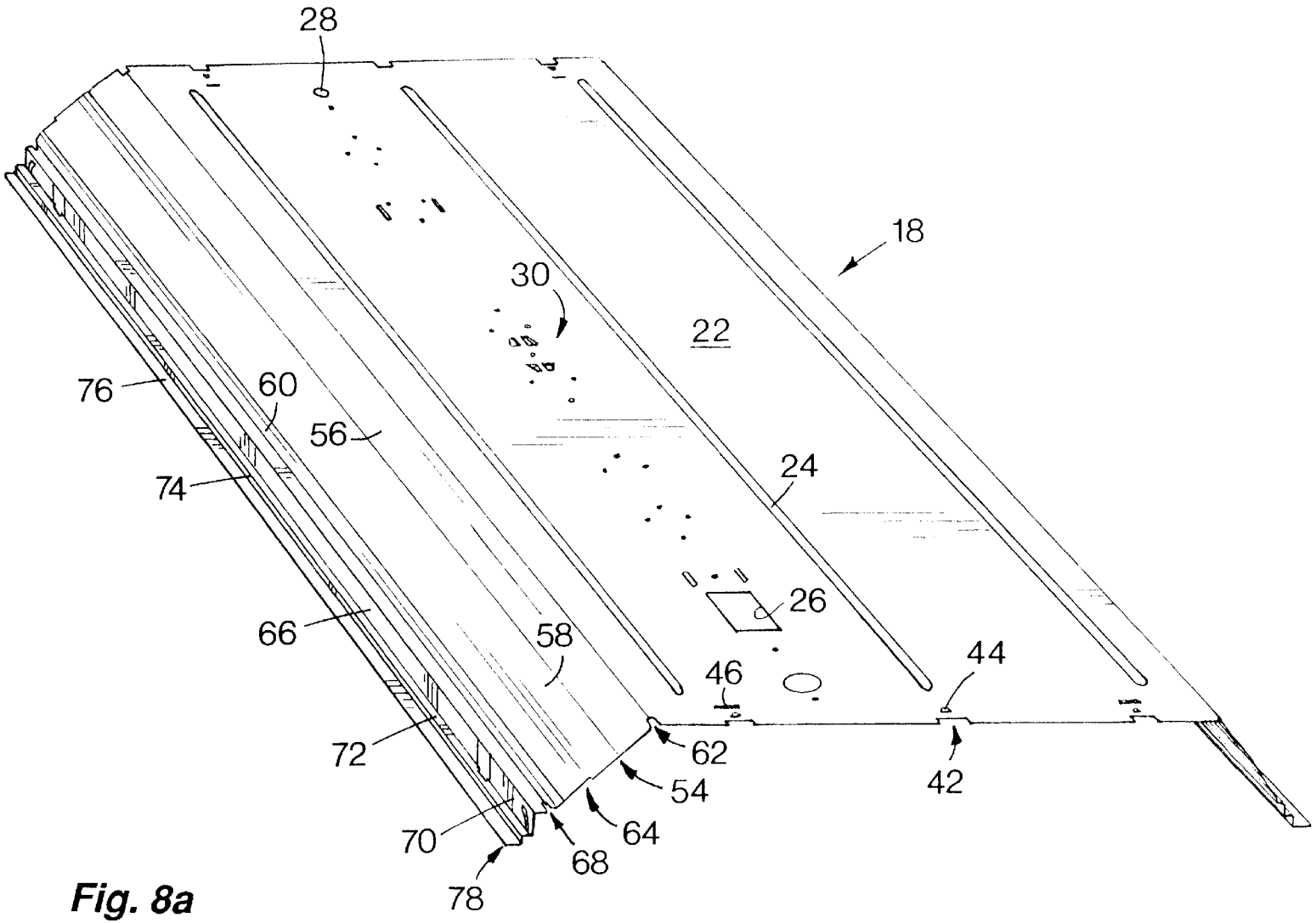
Figure 8B:
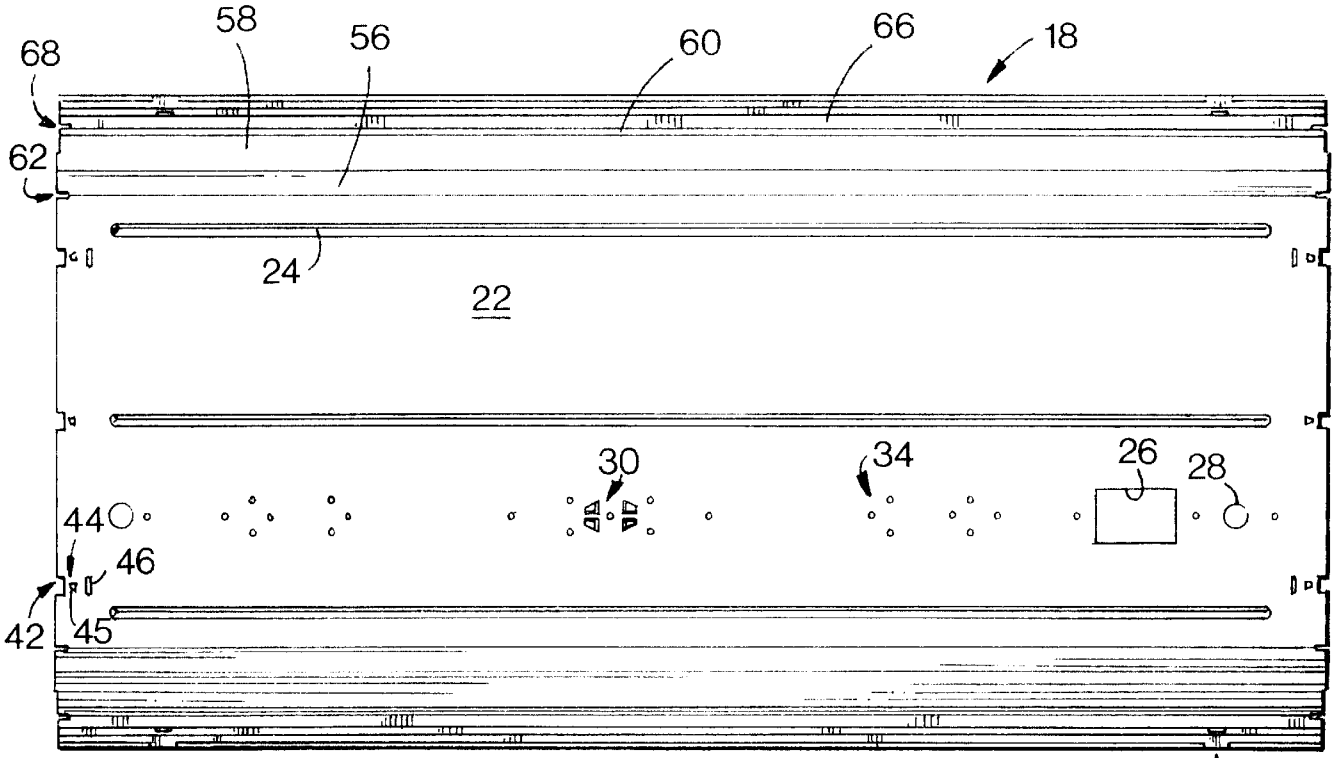
Figure 8C:
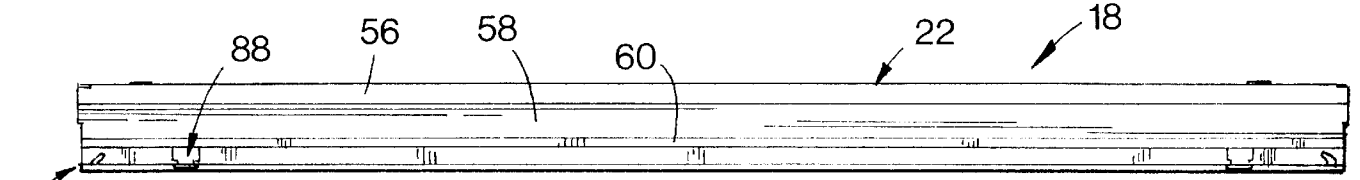
Figure 9A:
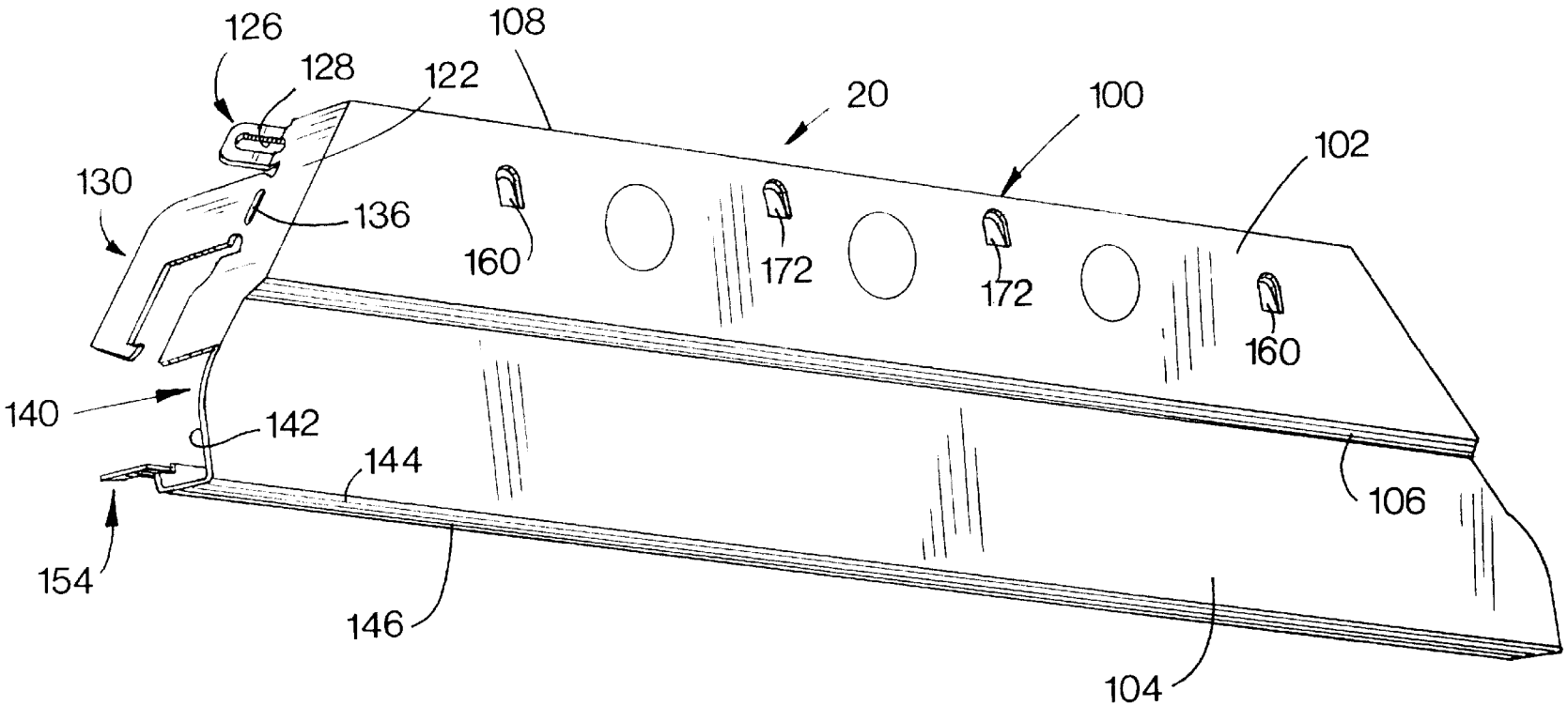
FIGS. 9A through 9E are exterior perspective, interior perspective, plan, side elevational and end elevational views respectively of an end plate forming a portion of a housing assembly of the invention.
Figure 9B:
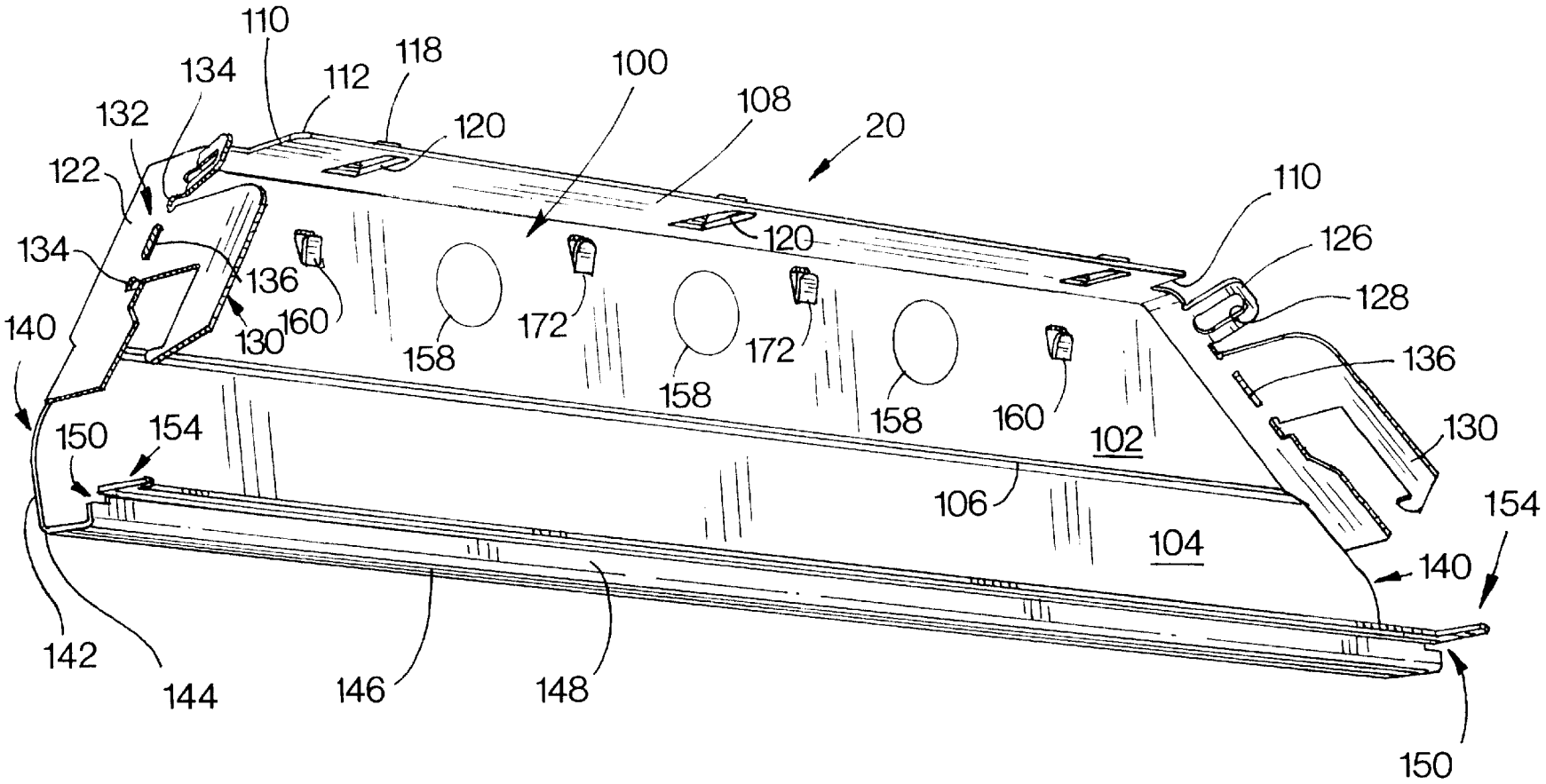
Figure 9C:
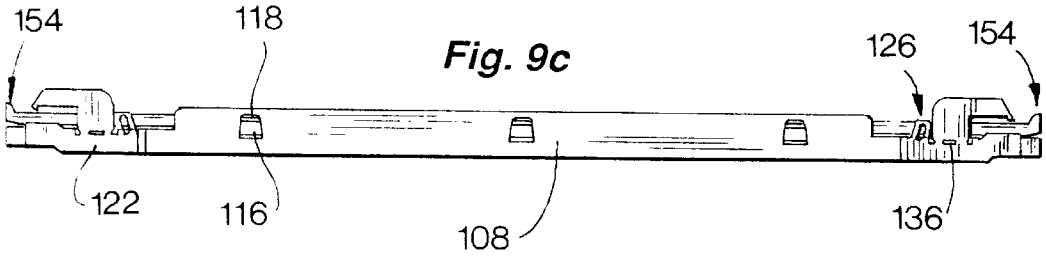
Figure 9D:
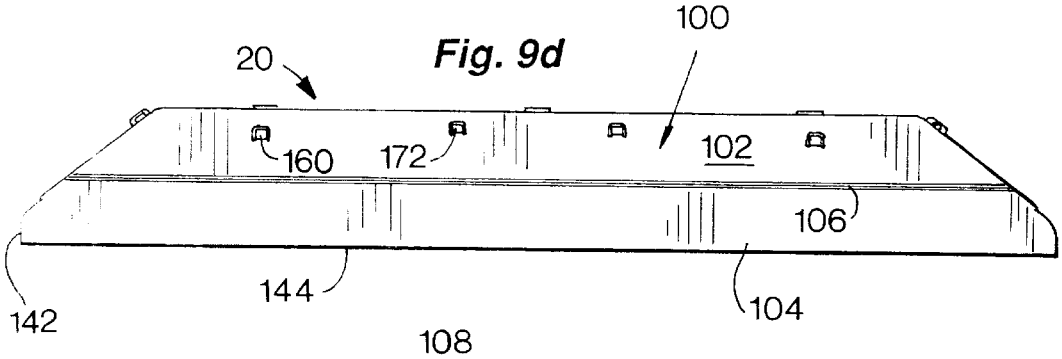
Figure 9E:
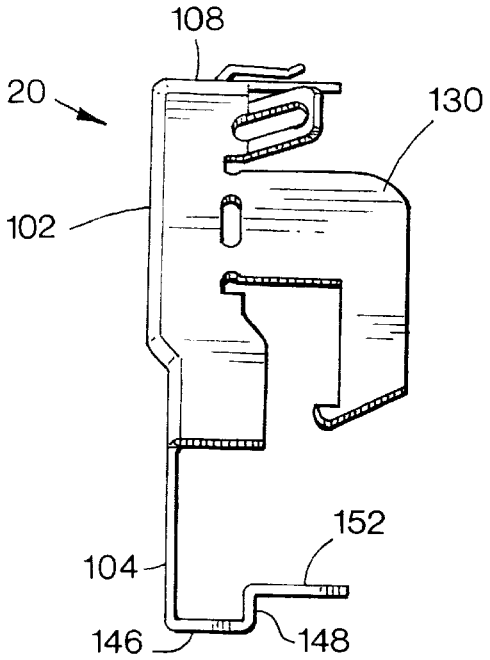

Each side portion of the housing channel 18 is essentially identical to the opposite side portion and thus description of one will suffice for description of both. The side portions of the housing channel 18 are essentially formed from the same planar piece of material as forms the upper body portion 22, the planar piece of material so formed being shaped by conventional apparatus to form side sections 54, each side section 54 being formed of three elongated planar portions 56, 58 and 60. The planar portions 56, 58 and 60 are angled relative to each other in order to effectively provide the reflective equivalent of a parabolic curve in each of the side sections 54. At the juncture of the planar portion 56 with the upper body portion 22 at each end of the channel 18, a longitudinal slot 62 is formed, a total of four of the slots 62 being provided for a purpose to be described hereinafter. Substantially centrally of each end of the planar portion 58, a shoulder 64 is notched into said planar portion 58, thereby reducing the effective length of the planar portion 58 along lower portions thereof as well as the length of remaining portions of the planar portion 60. A side ledge 66 is formed immediately outwardly of the planar portion 60, each of the side ledges 66 having a longitudinal notch 68 formed at either end of the channel 18 for receiving one of wings 178 of light trap element 174 to hold said element 174 in place. The side ledge 66 essentially comprises a planar body element which substantially lies in a plane parallel to the plane of the upper body portion 22. The side ledge 66 bends along its outer edge at essentially a 90° angle to form vertical ledge 70, the ledge 70 then bending along its outer edge at an angle of substantially 90° to form an intermediate, substantially horizontal ledge 72 which also extends essentially the full length of the housing channel 18 with the exception of the widths of the shoulders 64. At an outer edge of the ledge 72, the structure is bent downwardly at an angle of substantially 90° to form intermediate vertical ledge 74, the ledge 74 then bending outwardly at 90° to form terminal edge flange 76 which is preferably reversely bent over at its outer edge at 78 to strengthen the outer edge of the flange 76. The ledges 72 and 74 from a portion of a recess into which the door frame 14 fits. The vertical ledge 70 has a shaped aperture 80 formed near each end thereof, the aperture 80 having a substantially vertical portion at 82 at the lowermost edge of the ledge 70, the vertical portion 82 intersecting with an angled slot-like portion 84 which is rounded at its upwardly terminal end at 86. The aperture 80 can best be seen in FIG. 8E. Spaced inwardly from the shaped apertures 80 are slots 88 which are also formed in the vertical ledge 70, the slots 88 being compound slots having an upper enlarged rectangular portion 90 and a lower rectangular portion 92 which communicates with the portion 90 substantially medially of one side of said portion 90 to form each one of the slots 88. The slots 88 are best seen in FIG. 8E. The slots 88 on one side of the housing assembly 12 receive hinge elements 94 which are seen in FIG. 5 as comprising portions of the door frame 14, the hinge elements 94 being receivable within the two slots 88 formed along one side portion of the housing channel 18. The other pair of slots 88 located on the opposite side portion of the housing channel 88 receive for operation therein latching elements 96 which are also seen in FIG. 5 to comprise portions of the door frame 14. The hinge elements 94 and the latching elements 96 are described in detail as to structure and function in copending U.S. patent application Ser. No. 09/358,378 entitled "Door Frame for Lensed Troffer" as referred to hereinabove. The "bent over" portion 78 of each of the flanges 76 is discontinuous immediately opposite each of the slots 88 for a distance substantially equal to the length of the rectangular portion 90 of each slot 88, this structure facilitating operation of the hinge elements 94 and of the latching elements 96 as described in the aforesaid copending patent application which describes the door frame 14 in use with the housing assembly 12 of the present lighting fixture 10. The structure of the housing channel 18 is thus shown and described in detail, the utility thereof when not readily apparent as described hereinabove being elucidated by reference to cooperating structural components of the housing assembly 12 as will be described hereinafter.

The angular relationship of the side sections 54 of the housing channel 18 relative to the upper body portion 22 lends strength and rigidity to the housing assembly 12 and allows in part the formation of the housing assembly 12 with a depth-wise dimension which is desirable in installation of the lighting fixture 10 in reduced plenum installation situations. Interior surfaces of the housing channel 18 comprise reflective surfaces which are improved by a coating of highly reflective paint, particularly paint having diffuse characteristics, thereby to improve light output as well as to facilitate reduction of lamp image when a paint having diffuse characteristics is utilized.

Referring now to FIGS. 9A through 9E, one of the end plates 20 is seen in detail. Only one of the end plates 20 will be described herein since a description of one suffices for a description of both as the end plates 20 are essentially identical to each other and are interchangeable for use at either end of the housing channel 18. The end plate 20 is substantially trapezoidal in conformation by virtue of the shape of plate body 100 formed of upper and lower plate body portions 102 and 104. Each of the body portions 102 and 104 are substantially trapezoidal in shape, the portions 102 and 104 being joined at edges thereof through the exigency of a bend 106 in the material forming the plate body 100, the bend 106 causing the upper plate body portion 102 to extend outwardly of the housing assembly 12 relative to the lower plate body portion 104. It is to be understood that each of the end plates 20 is formed from a single sheet of material such as 22 gauge steel. The top edge of the plate body 100 takes the form of an upper flange 108 which is bent back inwardly of the plate body 100 along its full upper edge, the upper flange 108 taking the form of an elongated rectangle having notches 110 formed at outer corners thereof, the material at the innermost corner of the notch 110 being rounded at 112. Three friction tabs 116 having upturned free ends 118 are formed in the flange 108, one of the friction tabs 116 being centrally disposed along the flange 108 with the other two friction tabs being located essentially the same distance from the central friction tab 116 and toward the respective ends of the flange 108 at locations outwardly of the indentation 24. The friction tabs 116 are punched from the body of the flange 108 and each surmounts an opening 120 formed when the material comprising each one of the tabs 108 is punched from the body of the flange 108.

Lateral flanges 122 which are identical in conformation are formed at each end of the end plate 20 and are bent inwardly in the same direction as the upper flange 108 from the sheet of material forming the end plate 20, each of the lateral flanges 122 being essentially planar and generally rectangular in conformation and extending along a full side of the upper plate body portion 102 and a portion of the length of the lower plate body portion 104. A tab 126 having an aperture 128 extends at an angle from each of the lateral flanges 122 near the uppermost end of said flange 122. The tabs 126 are bent outwardly and support wiring or other material is tied through the aperture 128 to hang the lighting fixture 10 in certain installation situations. A hanger element 130 extends from the free elongated edge of the flange 122, the hanger elements 130 being shaped in the manner of a hook and in a conventional manner, the hanger elements 130 remaining in the plane of the flange 122 unless pushed outwardly to mount to a suspended ceiling structure such as a T-bar grid (not shown) of conventional design. The hanger elements 130 remain connected to the flanges 122 only through the agency of respective neck portions 132, the neck portions 132 each having a slot 136 formed therein to facilitate bending of the hanger element 130. The hanger elements 130 can be readily bent at the base of the neck portions 132 to position said hanger elements 130 for accomplishment of a conventional function. Notches 134 are formed on either side of the neck portion 132 to facilitate bending of each hanger element 130. The lower plate body portion 104 is rounded off at 140 below the flange 122 to form vertical edge 142 at each end of the end plate, the vertical edges 142 intersecting the lower edge 144 of the body portion 104, the edges 142 being essentially vertically oriented at the intersection with said body portion 104 at each end thereof. The lower edge 144 of the lower plate body portion 104 bends inwardly to form an elongated interior flange 146 which extends the full length of the lower edge 144 of said body portion 104. The flange 146 bends inwardly to form a connecting flange 148 which extends virtually the full length of the flange 146 except for notches 150 formed at each end thereof essentially at the juncture of the connecting flange 148 and lateral flange 152 which extends essentially the full length of the flange 146 and terminates in a shaped tab 154 having an arcuate free end which extends inwardly of the free edge of the flange 152. The flanges 148 and 152 cooperate to form a recess which communicates with a recess formed by the ledges 72 and 74 of the housing channel 18, the door frame 14 fitting into said recess.

The end plate 20 is further provided with a series of knockouts 158 provided in the upper plate body portion 102 at regular spacings thereof, the knockouts 158 being useful in the event that electrical wiring (not shown) or other structures are to be inserted into the interior of the lighting fixture 10 through the end plate 20. The end plate 20 can further be provided with a series of slots (not shown) formed either in the body portions 102, 104 or both, such slots functioning to ventilate the interior of the lighting fixture 10 and thus to remove heat. It is to be understood that such slots can be provided in patterns particularly intended for efficient heat removal. It is further to be understood that essentially circular apertures can be formed near corners of the plate body 100 to mount clips (not shown) which are required by code in areas having earthquake activity. Apertures (not shown) can also be formed in the plate body 100 to function as mountings for damper structure (not shown) used in some installations to damp air flow. Two pairs of tabs 160 and 172 are punched out of the upper plate body portion 102 near the top of the plate body 100. Each of the tabs 160 are located at one end of the plate body 100 and spaced essentially the same distance from the top edge of the body 100. The tabs 172 are formed inwardly of the tabs 160 and are located closer to the top edge of the body 100 than are the tabs 160. The pairs of tabs 160 and 172 facilitate mounting of socket plates of differing height as will be described hereinafter.

Figure 10B:
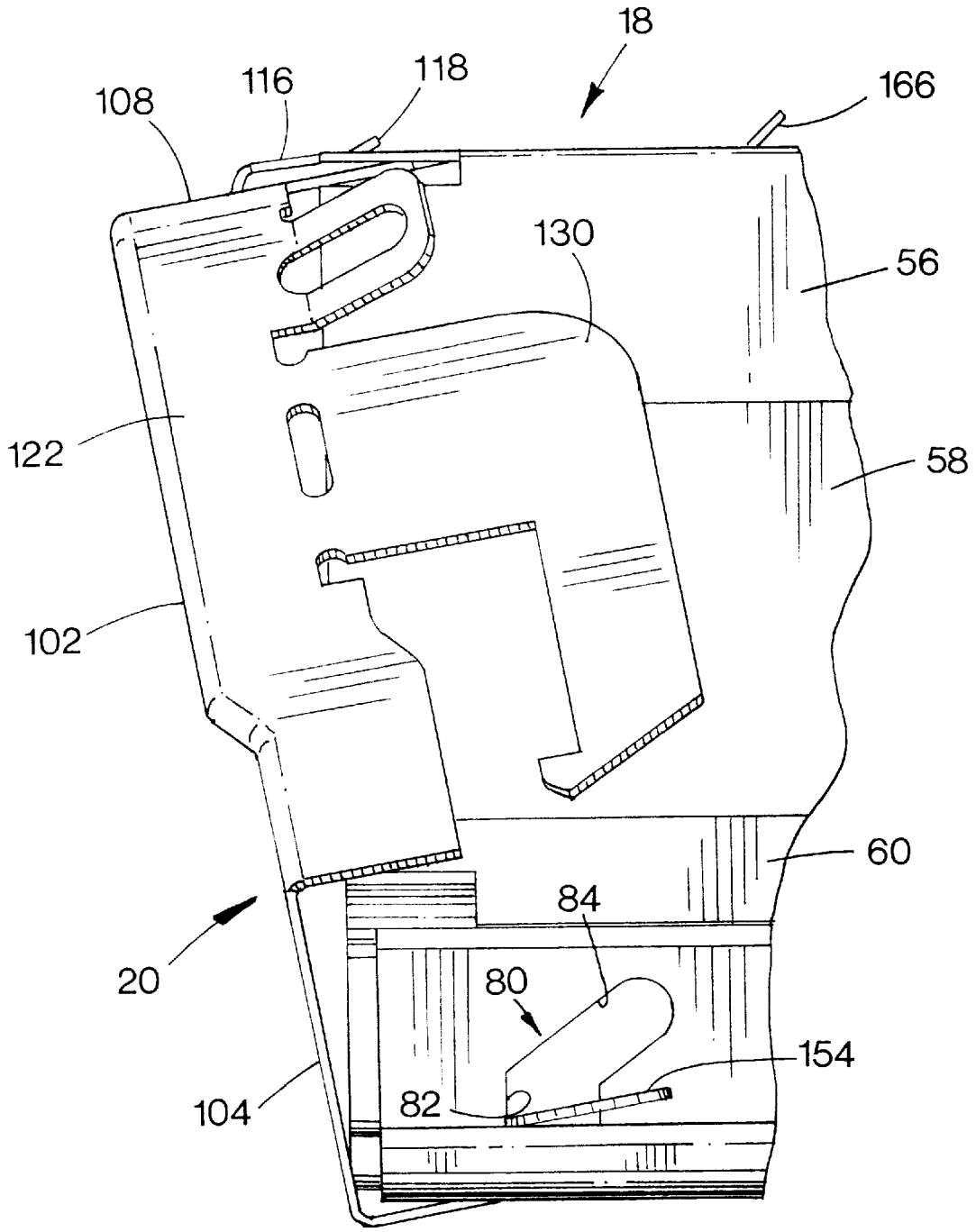
Figure 10C:
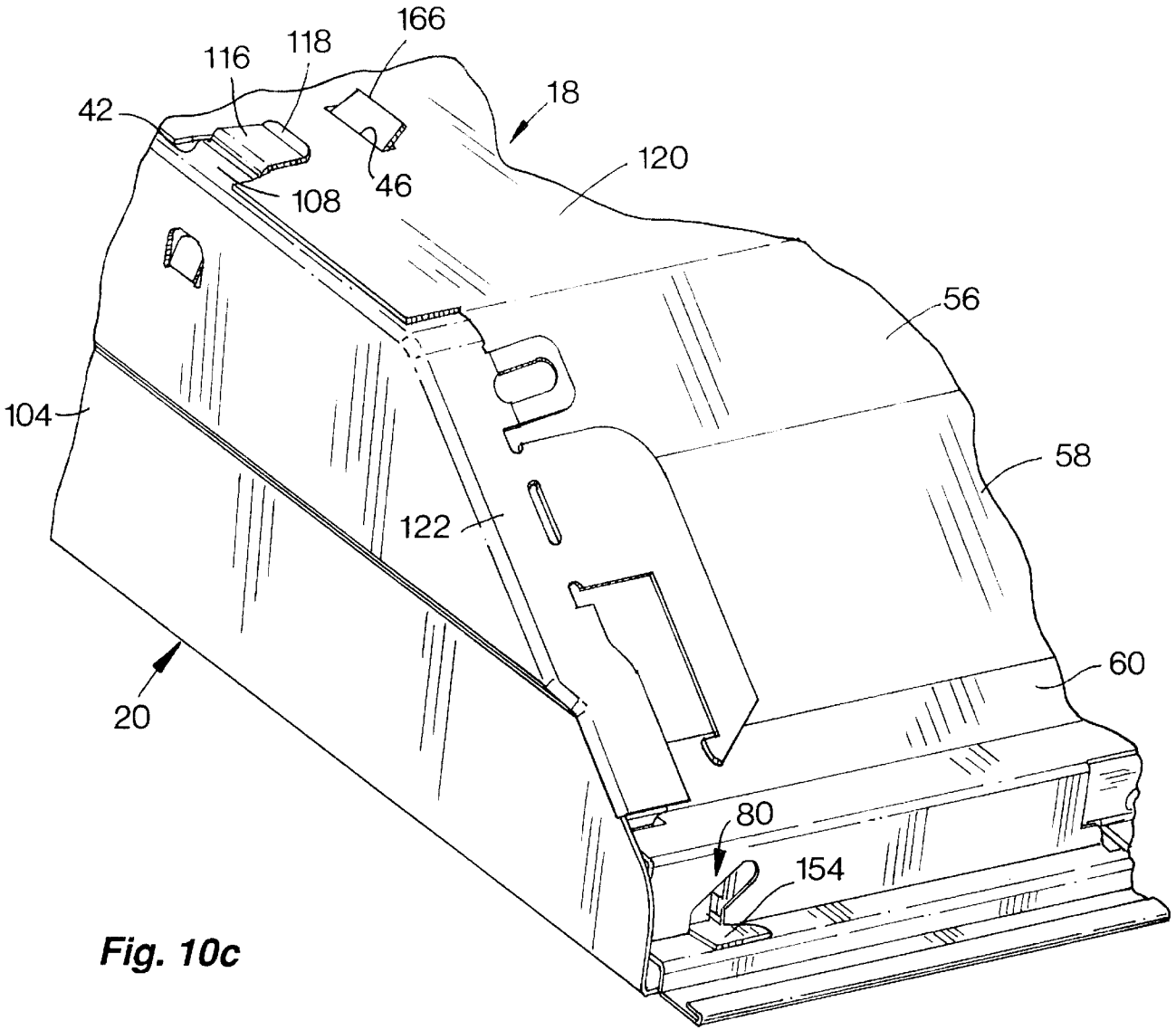

Referring now to FIGS. 10A, 10B and 10C, illustration is provided for the process of mounting the end plates 20 to the ends of the housing channel 18. Each of the end plates 20 are mounted in an identical fashion to the housing channel 18. Accordingly, description of the mounting of one of the end plates 20 to said channel 18 suffices for a description of both. As is seen in FIG. 10A, the shaped tab 154 at each lower end of each one of the end plates 20 is inserted into the shaped aperture 80 formed at each end of the housing channel 18 and on each side thereof, the shaped tabs 154 being inserted from inwardly of the housing channel 18 to extend outwardly thereof through each of the shaped apertures 80. On full receipt of the shaped tabs 154 into said shaped apertures 80, the body of the end plate 20 is rotated upwardly toward upper portions of the housing channel 18, the tabs 154 pivoting within the shaped aperture 80 from positions initially aligning with the angled slot-like portions 84 of said apertures 80, the portion 84 being of a greater length than the dimensions of the vertical portion 82 of the aperture 80, the shaped tab 154 thus being longer than the dimensions of the vertical portion 82 of said aperture 80, thereby to hold the tabs 154 within a lowermost portion, that is, the vertical portion 82 of the shaped aperture 80. As the tabs 154 are locking into the apertures 80, the upper flange 108 is fitting beneath edge portions of the ends of the upper body portions 22 of the housing channel 18, each of the friction tabs 116 fitting into and through one each of the cutouts 42 to engage upper surfaces of the channel 18. The upturned free ends 118 of the friction tabs 116 facilitate movement of the end plate 20 into location by preventing binding of ends of the friction tabs 116 against structure such as opposing edges of the cutouts 42. The free ends 118 of the tabs 116 on assembly of the end plate 20 to the channel 18 then bias againt upper surfaces of the channel 18 to prevent rising up of the channel 18 relative to the end plate 20. The friction tabs 116 therefore fit frictionally in position relative to the channel 18 when the end plate 20 is fully received onto the end of the housing channel 18. Free ends of the plates 45 angle downwardly to be received into the openings 120 wherein said free ends can engage front edges 119 of said openings 120. In this fully assembled position, the lateral flanges 122 fit over end portions of the side sections 54. As is seen in FIG. 10, the end plate 20 is shown to be assembled to the end of the housing channel 18. The simple integral fastening elements formed on the housing channel 18 and the end plates 20 act to effectively lock the housing channel 18 and the end plates 20 together to the degree that it is difficult to separate the end plates 20 from the housing channel 18 once assembled together. Free ends of the downwardly angles plates 45 abut front edges 119 of openings 120. Extension of the upper flange 108 beneath the end of the upper body portion 22 of the housing channel 18 coupled with the surmounting relationships of the lateral flanges 122 relative to ends of the side sections 54 contribute to the locking together of the end plates 20 to the housing channel 18 with the resulting difficulty of separating said plates 20 from said channel 18. Tension provided by the housing channel 18 itself, that is, the natural tendency of the side sections 54 of the housing channel 18 to bow outwardly can further act to hold the shaped tabs 154 within the apertures 80.

Figure 11:
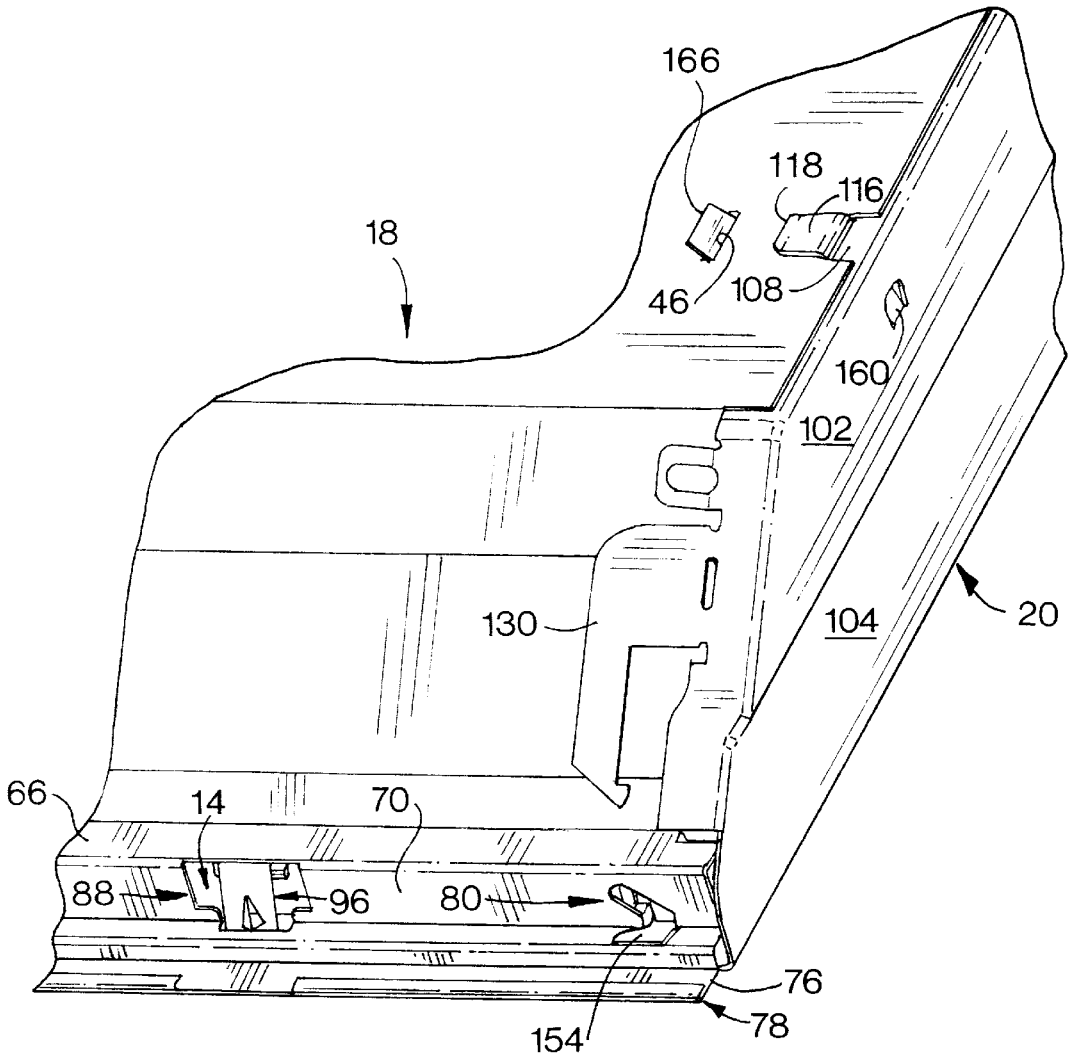
FIG. 11 is a detail perspective view of a corner portion of one end of the lighting fixture of the invention.
Figure 12:
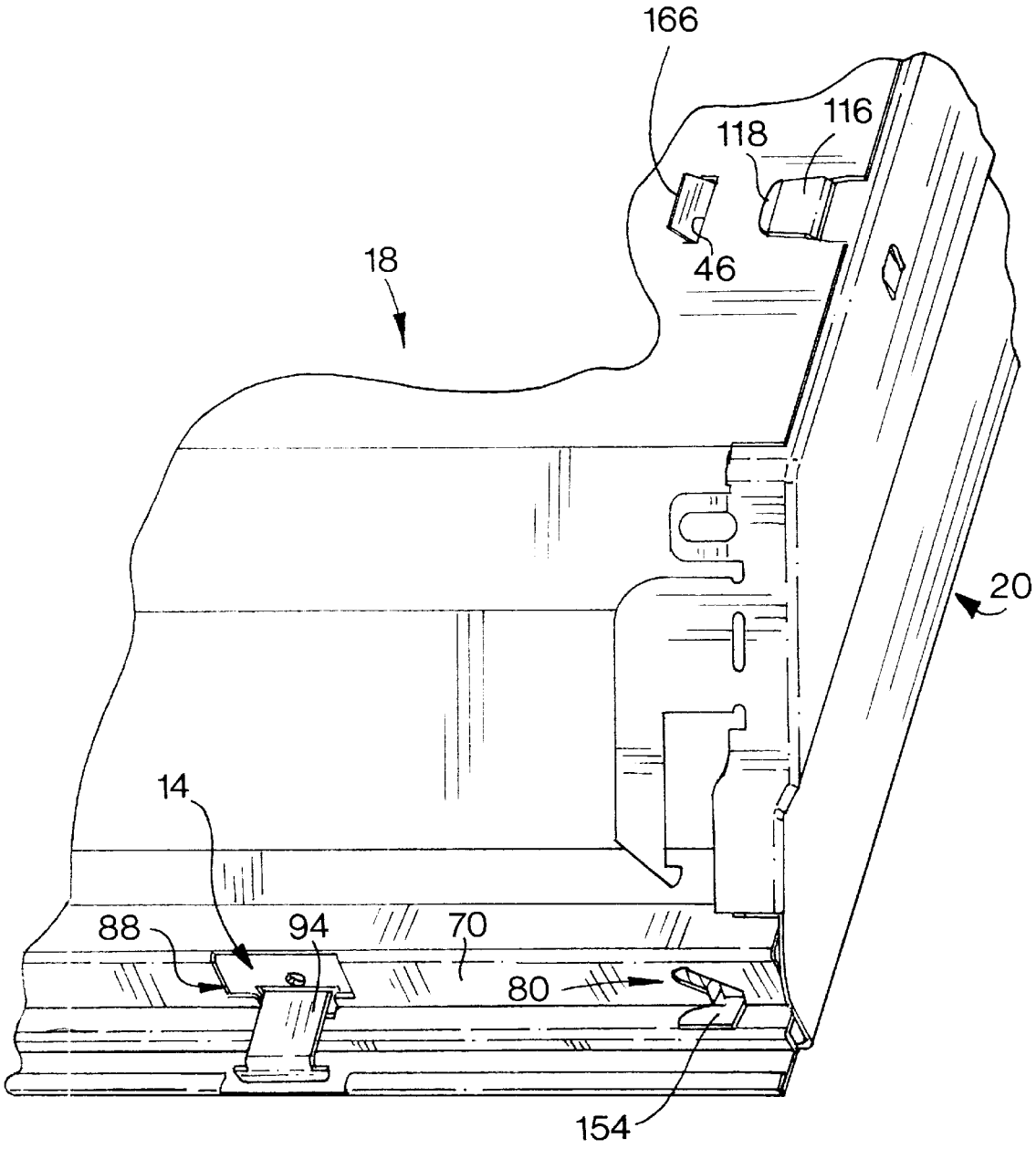
FIG. 12 is a detail perspective view of a corner portion of an end of the invention taken from the other side of the lighting fixture relative to that side seen in FIG. 11.

FIG. 11 illustrates the appearance of corner portions of the assembled housing channel 18 and one of the end plates 20 with the door frame 14 further being assembled thereto to effectively form a complete lighting fixture 10, the door frame 14 only being visible by virtue of the appearance of portions of one of the latching elements 96 as it extends through one of the slots 88, minor portions of the door frame 14 being visible through the slot 88. Similarly, FIG. 12 illustrates a corner of the fixture 10 showing full assembly of one of the end plates 20 to the housing channel 18 and wherein the door frame 14 is mounted to the housing assembly 12 thus formed. One of the hinge elements 94 mounted to the door frame 14 extends through one of the slots 88 on the opposite side edge of the fixture 10 from that side edge shown in FIG. 11. Essentially, the door frame 14 is not seen in FIG. 12 except through the slots 88 although the hinge element 94 also forms a part of the door frame 14.

Figure 13:
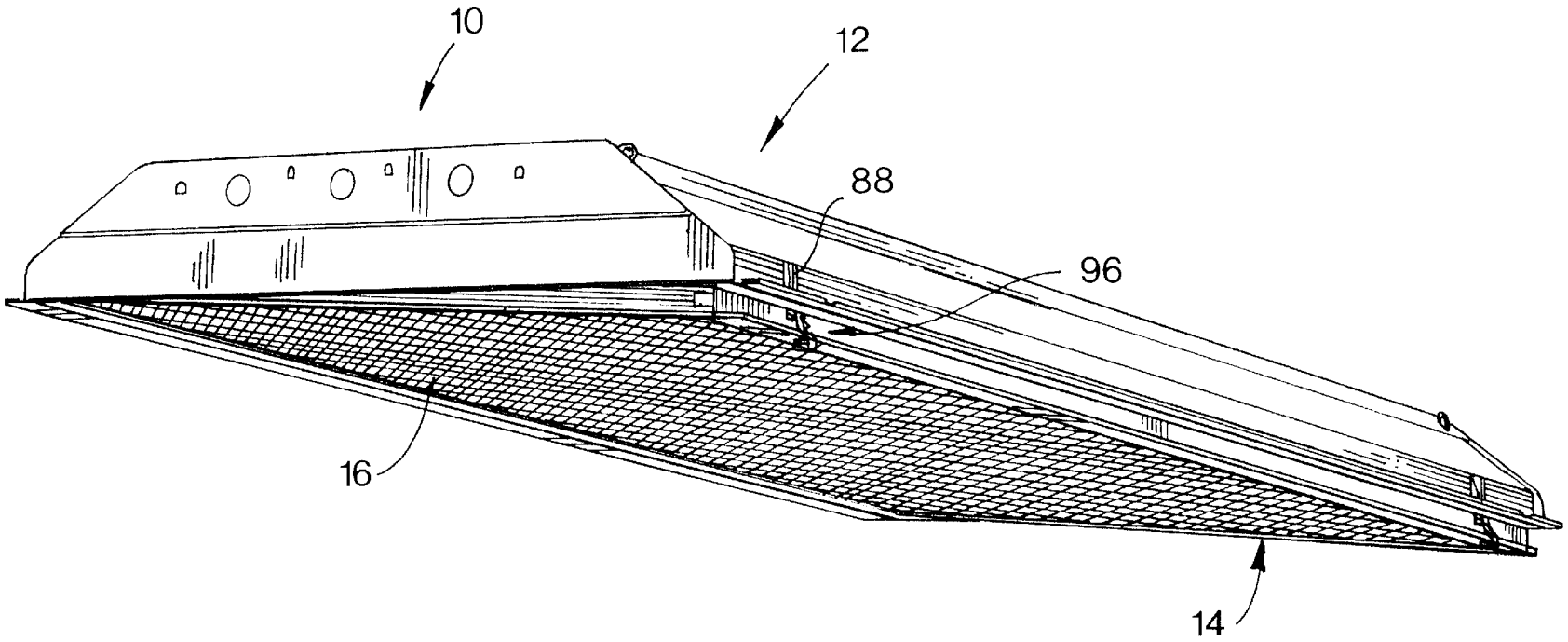
FIG. 13 is a perspective view of a lighting fixture having differing length-wise dimensions relative to the lighting fixture of FIGS. 1 through 4 inter alia, the lighting fixture of FIG. 13 illustrating a door frame unlatched from a housing assembly of the invention, a prismatic lens cover normally carried by the door frame being removed for convenience of illustration.
Figure 14:
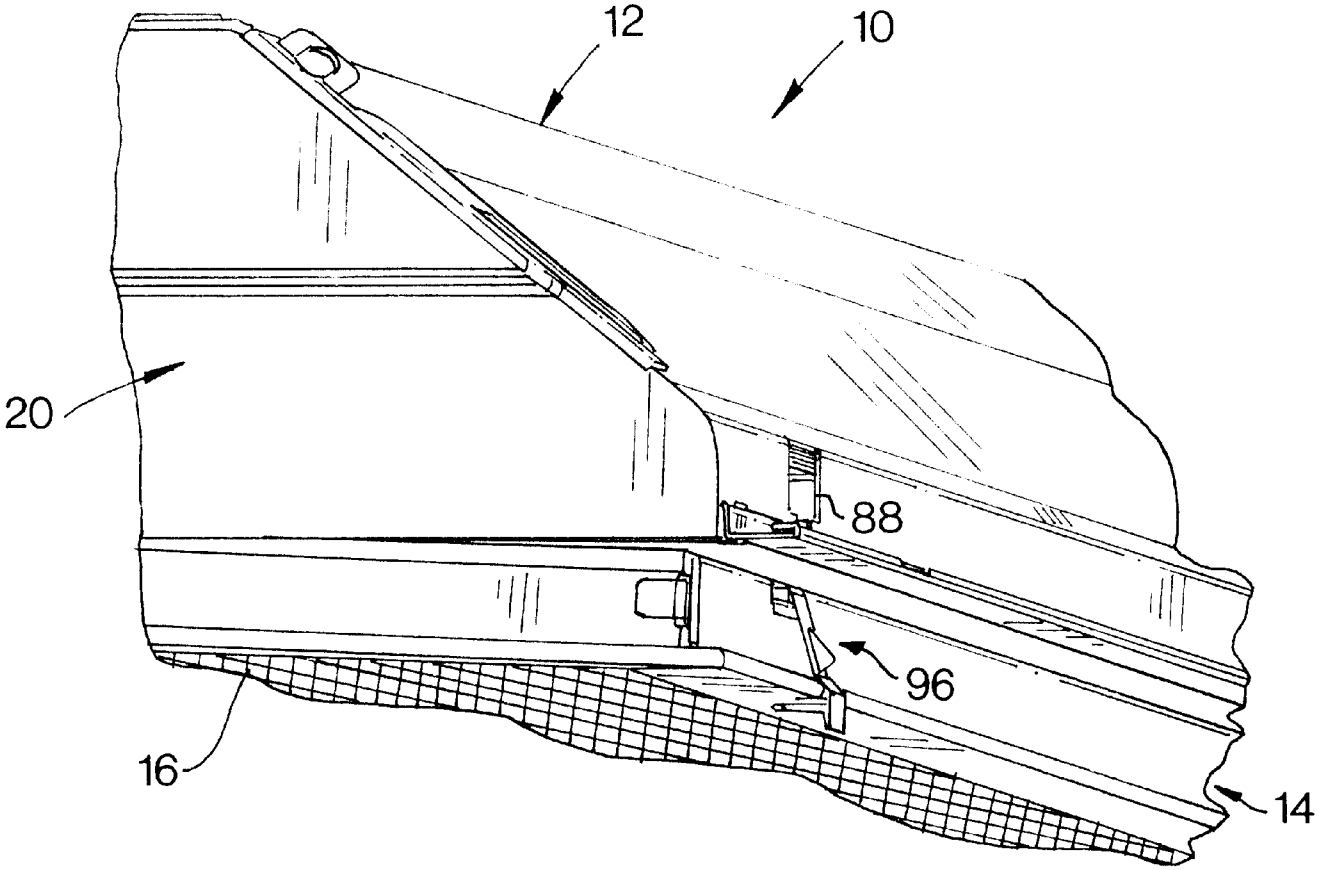
FIG. 14 is a detail perspective view of the lighting fixture illustrating the door frame in an unlatched configuration relative to the housing assembly.
Figure 15A:
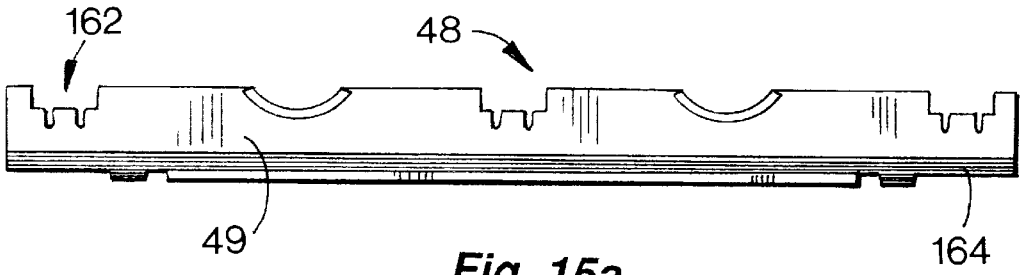
FIGS. 15A through 15D are side elevational, plan, perspective and end elevational views of a socket plate.
Figure 15B:
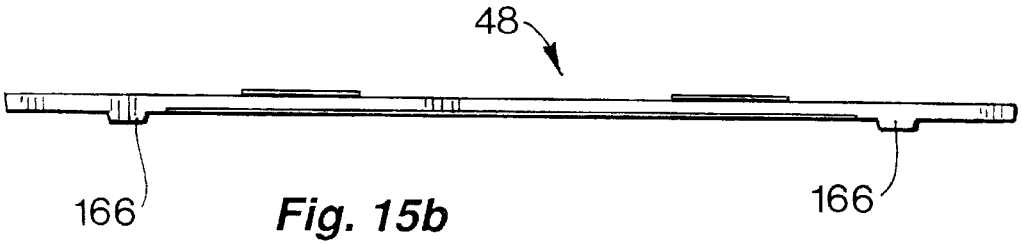
Figure 15C:
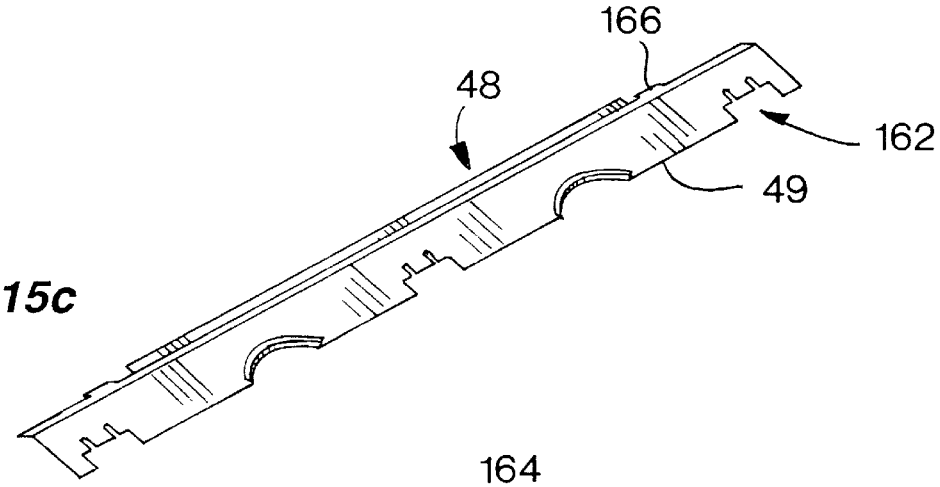
Figure 15D:
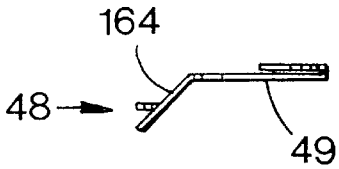

Referring now to FIG. 13, the door frame 14 is shown as assembled to the housing assembly 12 but with the latching elements 96 disengaged from the slots 88 formed along one edge of the housing assembly 12. It is to be understood that the door frame 14 can be rotated downwardly from the position shown in FIG. 13 with the hinge elements 94 (not shown) acting to create a line along the opposite side edge of the housing assembly 12 about which the door frame 14 pivots to open up the interior of the lighting fixture 10 from beneath said fixture 10 for maintenance or the like including relamping, etc. The lens cover 16 can be easily removed for maintenance. In FIG. 14, a detail view is seen of a corner of the fixture 10 as shown in FIG. 13, the door frame 14 carrying the lens cover 16 as seen in FIG. 14. A complete description of the structure and function of the door frame 14 including the structure and function of the hinge elements 94 and the latching elements 96 is provided in copending U.S. patent application Ser. No. 09/358,378, entitled "Door Frame for Lens Troffer", filed of even date and assigned to the present assignee as aforesaid.

Figure 7:
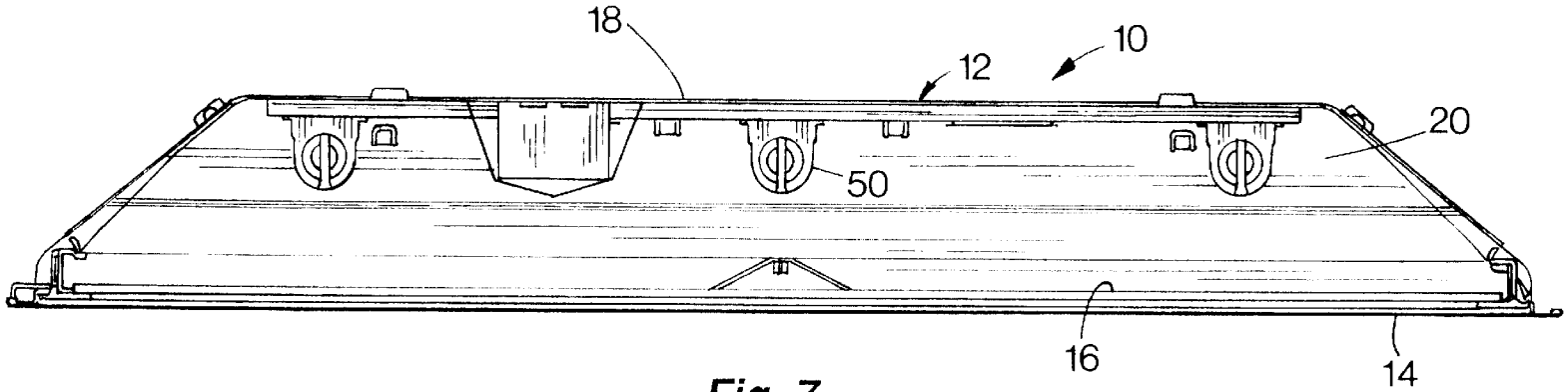
FIG. 7 is an end elevational view of the lighting fixture of the invention with an end plate removed so that interior portions of the fixture can be seen.

Referring now to FIGS. 15A through 15D as well as FIG. 11 inter alia, the socket plate 48 is seen to comprise a body portion 49 having an edge within which shaped cutouts 162 are formed, the cutouts 162 allowing mounting of one each of the sockets 50 in a conventional fashion. The sockets 50 extend upwardly from the plane of the body portion 49 and receive lamping such as the lamp 52 of FIG. 5. The opposite edge of the body portion 49 has an angled flange 164 extending therefrom, the flange 164 having tabs 166 extending from an outer edge thereof, the tabs 166 being receivable one each within each one of the slots 46 formed in the upper body portion 22 of the housing channel 18. As seen in FIG. 11 inter alia, the tabs 166 extend outwardly of the housing channel 18 through said slots 46. Depending upon the size of the socket plate 48, either the pair of the tabs 160 or the pair of the tabs 172 formed in the upper plate body portion 102 of each of the end plates 20 extend inwardly of the housing assembly 12 to bias against the socket plate 48, thereby facilitating secure assembly of the socket plate 48 at each end of the housing assembly 12. In essence, the socket plates 48 and the sockets 50 mounted thereby are conventional in the art. The sockets 50 mount T8 lamping such as the lamps 52 referred to above. In a specification premium embodiment of the lighting fixture 10, the distance between lower portions of the lamps 52 and an upper face of the lens cover 16 is identical to the distance between lower portions of T12 lamping and an upper face of a lens cover in similar lensed troffer lighting fixtures utilizing T12 lamping, this distance being desirable for maintenance of an adequate obscuration of lamp image. Typically, the lighting fixtures 10 formed according to the invention have a height of approximately 3.65 inches in a specification premium embodiment and approximately 3.14 inches in a non-specification troffer embodiment. FIG. 7 essentially illustrates the positions within the interior of the lighting fixture 10 at which the lamps 52 (not shown in the Figure) would be located as mounted by the sockets 50. The distance from lower portions of the lamps to an upper face of the lens cover 16 would be that straight line distance downwardly from the sockets 50 to the lens cover 16.

The exploded views of FIGS. 5 and 6 illustrate the assembly arrangement of the various structural components of the lighting fixture 10 and provide additional showings of the manner in which the various structural components of the lighting fixture 10 come together into assembled relationships.

Figure 17:
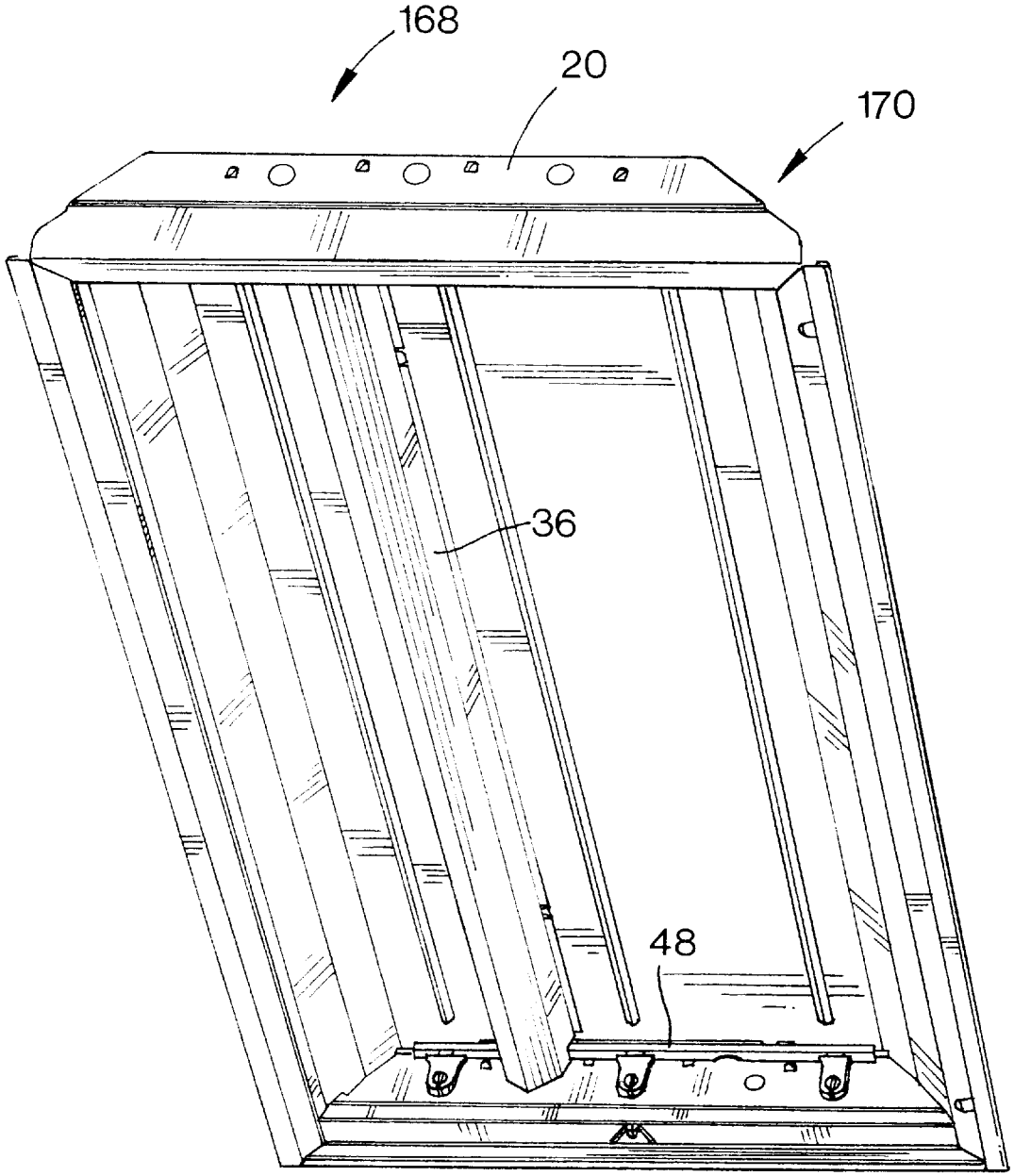
FIG. 17 is a perspective view of the housing assembly of FIG. 13 illustrating the channel cover of FIG. 16 in place within the housing assembly.
Figure 18:
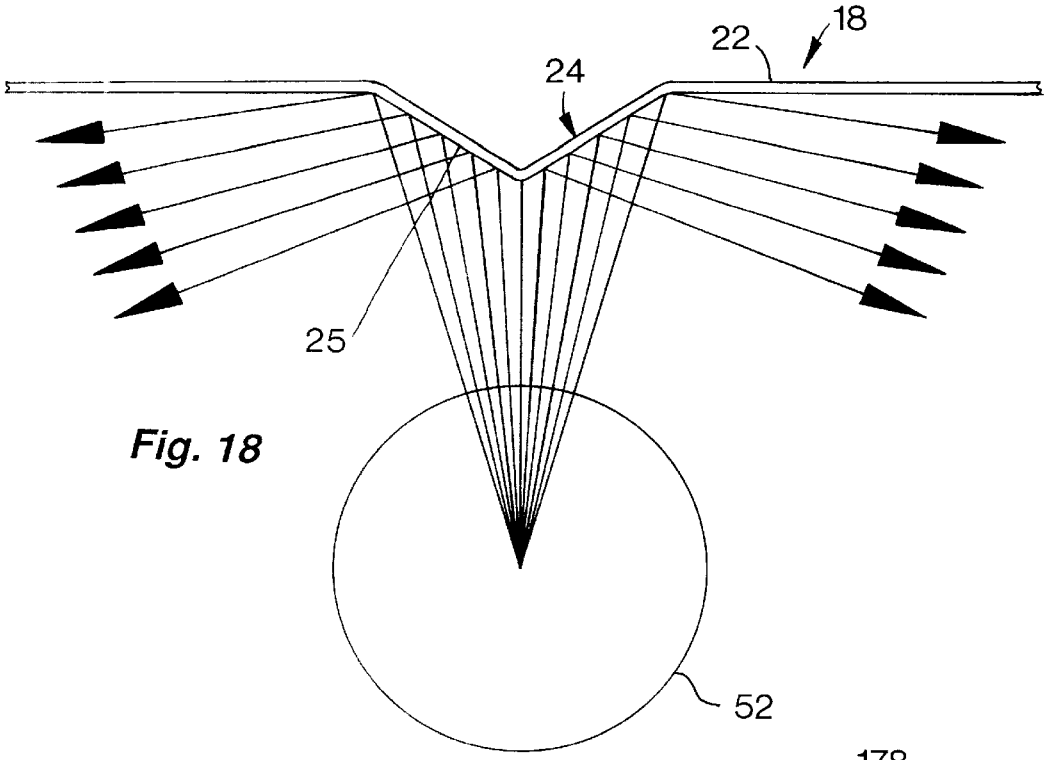
FIG. 18 is a schematic illustrating the function of an indentation formed in the housing channel above one of the lamps; and, FIGS. 19A through 19D are perspective, end elevational, side elevational and plan views of a light trap element mountable to corners of each end plate to minimize light leakage from the fixture.
Figure 19A:
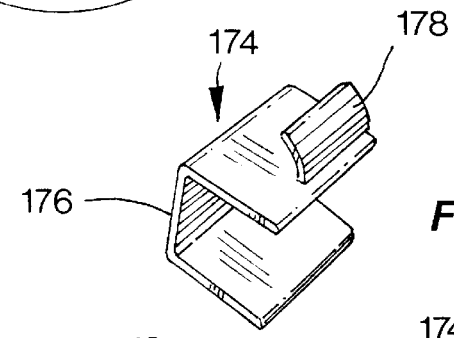
Figure 19C:
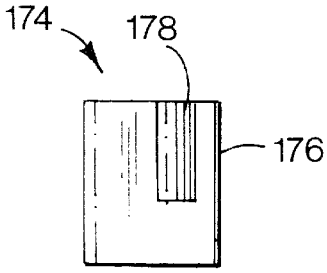
Figure 19B:
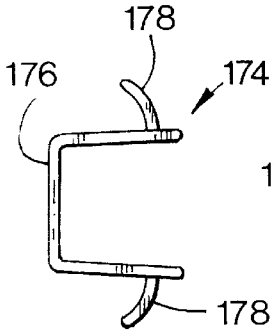
Figure 19D:
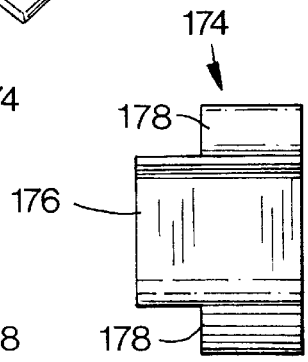

A lighting fixture 168 as seen in FIGS. 16 and 17 is seen to be identical to the lighting fixture 10 with the exception that the lighting fixture 168 is formed as a two foot by two foot square while the lighting fixture 10 has effective dimensions of two feet by four feet. The lighting fixture 168 is shown to illustrate a differing dimensional conformation of a lighting fixture configured according to the invention as well as to show in assembly relationship the channel cover 36 to remaining portions of housing assembly 170 and in an assembled relationship thereto in FIG. 17. It is to be understood that channel covers such as the channel cover 36 are conventional in the art and need not be described in detail herein. It is further to be understood that previous reference has been made herein to the channel cover 36 and its function in covering the ballast 32 as well as other structure aligned with the ballast 32 and the access opening 26 inter alia. The different dimensional embodiments of the invention can typically be formed with two, three and four lamps, it being necessary to utilize a socket plate such as the plate 48 configured for the particular number of lamps employed in a given fixture.

FIG. 18 diagrammatically illustrates the function of the indentations 24 formed in the upper body portion 22 of the channel 18, light emanating upwardly from the lamp 52 reflecting from angled surfaces 25 of each of the indentations 24 and being thus directed at angles which allow the reflected light to move through the lens cover 16 and out of the fixture 10. Light output is thus increased.

Referring now to FIGS. 19A through 19D, a light trap element 174 is seen to be comprised of a U-shaped body member 176 having projecting arcuate wings 178 extending outwardly of each of the leg portions of the body member. The light trap element 174 is assembled to the junction of the end plates 20 and the channel 18 after assembly of the end plate 20 to the housing channel 18 to prevent light leakage from the shaped apertures 80 and from the junction of the end plates 20 and the channel 18. As aforesaid, one of the wings 178 fits into the notch 68 formed in the channel 18. The other wing 178 fits into the channel formed by the elements 104, 146 and 148 of the end plate 20 at each end thereof, the elements 104, 146 and 148 being best seen in FIG. 9E. The free end of this other wing 178 contacts inner wall surfaces of the element 146 and biases thereagainst. The wings 178 are arcuate in order to provide compression. While only one of the wings 178 needs to be arcuate, both are arcuately formed so that either of the wings 178 can be placed into the channel formed by the elements 104, 146 and 148.

It is to be understood that the lighting fixtures 10 and 168 can be configured other than as explicitly shown and described herein without departing from the scope of the invention as defined by the appended claims.

What is claimed is:

1. A lighting fixture having at least one lamp carried within the lighting fixture, comprising:

a housing channel having an upper, substantially planar body portion and side walls depending from said body portion along opposed edges of said planar body portion, the side walls being angled relative to the plane of the planar body portion to form a substantially trapezoidal cross-section;

an end plate mounted to each end of the housing channel, the end plate having a substantially trapezoidal body portion, a depending top flange extending substantially at right angles from a top edge of the trapezoidal body portion, depending side flanges extending one each from side edges of the trapezoidal body portion, each side flange being angled relative to the top flange, mounting of each end plate to an end of the housing channel causing the top flange of each end plate to be received beneath the planar body portion of the housing channel at the ends thereof respectively, the side flanges of each end plate fitting over the side walls of the housing channel; and, means carried by each of the housing channel and each end plate and cooperating each with the other for mounting each end plate to one end of the housing channel.

2. The lighting fixture of claim 1 wherein the mounting means are formed integrally with either the housing channel or each end plate, the said means snap-fitting the end plate to the housing channel without the use of separate fasteners.

3. The lighting fixture of claim 1 wherein the planar body portion of the housing channel has at least one elongated indentation formed therein substantially above and extending along the length of each lamp carried by the fixture, the indentation being substantially triangular in cross-section with a free apex of one angle thereof extending toward the lamp, side walls of the indentation facing into the interior of the fixture forming reflective surfaces which reflect light from above the lamp to prevent light from being trapped above said lamp.

4. The lighting fixture of claim 1 wherein the planar body portion of the housing channel has an elongated indentation formed therein substantially above and extending the length of at least one of the lamps carried by the fixture, the indentation having surfaces facing into the interior of the fixture forming reflective surfaces which reflect light from above the lamp to prevent light from being trapped above said lamp.

5. The lighting fixture of claim 1 and further comprising means disposed above at least one of the lamps carried by the fixture for reflecting light from above the lamp to prevent light from being trapped above said lamp.

6. The lighting fixture of claim 1 wherein the mounting means comprise at least one friction tab formed on the top flange of the end plate, the friction tab engaging a surface of the planar body portion of the housing channel on mounting of each end plate to the housing channel.

7. The lighting fixture of claim 6 wherein the friction tab comprises a tab body portion which is angled from the plane of the top flange of the end plate, the tab body portion turning upwardly at the free end thereof, a friction surface being formed essentially at the juncture of the tab body portion and the upturned free end of the friction tab, the friction surface engaging a surface of the planar body portion of the housing channel.

8. The lighting fixture of claim 7 wherein the mounting means comprise an indentation formed in the surface of the planar body portion of the housing channel at the location thereof contacting the friction surface of the friction tab formed on the end plate, thereby to facilitate frictional contact between the friction tab and the housing channel.

9. The lighting fixture of claim 8 wherein each end of the planar body portion of the housing channel is formed with at least one notch therein, the notch receiving the friction tab thereinto on mounting of each end plate to each end of the housing channel, a posterior end of the tab body portion engaging an oppositely disposed edge of the notch on full receipt of the end plate onto the housing channel and on full engagement of the friction surface of the friction tab with the indentation.

10. The lighting fixture of claim 8 wherein the friction tab and the indentations are formed integrally respectively with the top flange of the end plate and the planar body portion of the housing channel.

11. The lighting fixture of claim 10 wherein the friction tab and the indentations are punched from material forming the top flange of the end plate and the planar body portion of the housing channel.

12. The lighting fixture of claim 1 wherein the housing channel has a shaped slot formed in each corner of each side wall at each end thereof, each slot being longer in a direction slanted upwardly at an angle from a lower portion of the slot than the length thereof along the lower portion of the slot, the mounting means further comprising a shaped tab at each end of the end plate, the tab being of a length which allows fitting of the tab through an angled portion of the slot on tilting of the end plate relative to the end of the housing channel, pivoting of the end plate about its lower edge causing the shaped tab to move to a position whereby a neck of the shaped tab having a lesser length than the shaped tab fits within the lower portion of the shaped slot, the shaped tab being held within the shaped slot by virtue of the greater length of the shaped tab extending through and from the other side of the shaped slot, pivoting of the end plate toward the upper planar body portion of the housing channel causing mounting of said end plate to said housing channel.

13. The lighting fixture of claim 12 and further comprising a light trap clip engageable with the end plate at junctures with the housing channel in proximate relation to the shaped slot, thereby to prevent light from leaking through the juncture between the end plate and the housing channel at areas proximate to the shaped slot.

14. A lighting fixture having at least one lamp carried within the lighting fixture, comprising:

a housing channel having an upper, substantially planar body portion and side walls depending from said body portion along opposed edges of said planar body portion;

an end plate mounted to each end of the housing channel, the end plate having a body portion, a depending top flange extending substantially at right angles from a top edge of the body portion, depending side flanges extending one each from side edges of the body portion, mounting of each end plate to an end of the housing channel causing the top flange of each end plate to be received beneath the planar body portion of the housing channel at the ends thereof respectively, the side flanges of each end plate fitting over the side walls of the housing channel; and, means carried by each of the housing channel and each end plate and cooperating each with the other for mounting each end plate to one end of the housing channel.

15. The lighting fixture of claim 14 wherein the mounting means are formed integrally with either the housing channel or each end plate, the said means snap-fitting the end plate to the housing channel without the use of separate fasteners.

16. The lighting fixture of claim 14 wherein the mounting means comprise at least one friction tab formed on the top flange of the end plate, the friction tab engaging a surface of the planar body portion of the housing channel on mounting of each end plate to the housing channel.

17. The lighting fixture of claim 16 wherein the friction tab comprises a tab body portion which is angled from the plane of the top flange of the end plate, the tab body portion turning upwardly at the free end thereof, a friction surface being formed essentially at the juncture of the tab body portion and the upturned free end of the friction tab, the friction surface engaging a surface of the planar body portion of the housing channel.

18. The lighting fixture of claim 17 wherein the mounting means comprise an indentation formed in the surface of the planar body portion of the housing channel and defining a plate member having a free end, the free end abutting an edge portion of an opening formed in the end plate which the friction tab surmounts.

19. The lighting fixture of claim 18 wherein each end of the planar body portion of the housing channel is formed with at least one notch therein, the notch receiving the friction tab thereinto on mounting of each end plate to each end of the housing channel, a posterior end of the tab body portion engaging an oppositely disposed end of the notch on full receipt of the end plate onto the housing channel and on full engagement of the friction surface of the friction tab with the indentation.

20. The lighting fixture of claim 14 wherein the planar body portion of the housing channel has an elongated indentation formed therein substantially above and extending along the length of each lamp carried by the fixture, the indentation being substantially triangular in cross-section with a free apex of one angle thereof extending toward the lamp, side walls of the indentation facing into the interior of the fixture and forming reflective surfaces which reflect light from above the lamp to prevent light from being trapped above said lamp.

21. The lighting fixture of claim 1 wherein the mounting means comprise at least one friction tab formed in the top flange of the end plate, the friction tab engaging an upper surface of the planar body portion of the housing channel on mounting of each end plate to the housing channel.

22. The lighting fixture of claim 1 wherein upper surfaces of the top flange of each end plate contact lower surfaces of the housing channel at an end thereof substantially along the full length of the top flange.

23. The lighting fixture of claim 22 wherein lower surfaces of the side flanges of each end plate contact upper surfaces of the housing channel at an end thereof substantially along the full length of each of the side flanges.

24. The lighting fixture of claim 9 wherein the friction tab surmounts an opening formed in the top flange of each of the end plates, the opening having a distal edge surmounted by a free end of the friction tab, and wherein the indentation is formed in the planar body portion of the housing channel immediately inwardly of the at least one notch, the indentation having a plate element formed therewith, the plate element having a distal edge portion, the distal edge portion of the plate element engaging the edge of the opening formed in the end plate on full receipt of the end plate onto the housing channel and on fill engagement of the friction surface of the friction tab with the indentation.

25. The lighting fixture of claim 24 wherein the first tab and the indentation are punched from material forming the top flange of the end plate and the planar body portions of the housing channel.

* * * * *